US005123259A

United States Patent [19]

Morgan, Sr.

[11] Patent Number: 5,123,259

[45] Date of Patent: Jun. 23, 1992

[54] REFRIGERANT RECOVERY SYSTEM

[75] Inventor: Edward C. Morgan, Sr., Memphis, Tenn.

[73] Assignee: B M, Inc., Memphis, Tenn.

[21] Appl. No.: 629,262

[22] Filed: Dec. 17, 1990

[51] Int. Cl.[5] ..... F25B 45/00

[52] U.S. Cl. ..... 62/292; 62/149; 62/474; 62/77

[58] Field of Search ..... 62/77, 85, 474, 475, 62/292, 149

[56] References Cited

U.S. PATENT DOCUMENTS

| | | | |
|---|---|---|---|
| 3,232,070 | 2/1966 | Sparano | 62/149 |
| 4,554,792 | 11/1985 | Margulefsky et al. | 62/77 |
| 4,766,733 | 8/1988 | Scuderi | 62/77 |
| 4,805,416 | 2/1989 | Mauz et al. | 62/292 |
| 4,809,520 | 3/1989 | Manz et al. | 62/292 |
| 4,856,289 | 8/1989 | Lofland | 62/149 |
| 4,903,499 | 2/1990 | Merritt | 62/77 |
| 4,909,042 | 3/1990 | Proctor et al. | 62/149 |
| 4,967,570 | 11/1990 | Van Steenburgh, Jr. | 62/292 |

*Primary Examiner*—Albert J. Makay
*Assistant Examiner*—John Sollecito
*Attorney, Agent, or Firm*—Walker & McKenzie

[57] ABSTRACT

An apparatus and method for refrigerant recovery which removes refrigerant in liquid form from an air conditioning unit by cooling the refrigerant, thereby creating a temperature gradient between the air conditioning unit and the recovery apparatus which urges the refrigerant from the air conditioning unit into the apparatus, and then storing the refrigerant in a tank. Refrigerant vapor is pumped from the tank back into the air conditioning unit, thereby avoiding pressure buildup in the tank and also preventing the liquid refrigerant from being retained in the air conditioning unit due to vacuum created therein by the refrigerant removal. Cooling apparatus within the recovery apparatus uses a separate supply of refrigerant to cool the refrigerant, and neither the air conditioning unit itself nor the removed refrigerant is used for this purpose, allowing refrigerant removal from an inoperative air conditioning unit. The refrigerant recovery apparatus may also remove moisture and oil from the refrigerant during the removal and replacement operations. The apparatus may be configured to evacuate the air conditioning unit, to remove oil from the air conditioning unit, to distill the removed refrigerant, and to replace the refrigerant back into the air conditioning unit. The machine may be portable, or may be constructed as a recovery station for bulk processing of refrigerant.

20 Claims, 9 Drawing Sheets

REFRIGERANT RECOVERY SYSTEM

BACKGROUND OF THE INVENTION

1. Field of the Invention:

The present invention relates, in general, to devices and methods for maintaining air conditioning or refrigerant equipment, and in particular, to a method and system for removing liquid chlorinated fluorocarbon refrigerant from an air conditioning unit, cleaning the removed refrigerant, and replacing it back into the air conditioning unit.

2. Information Disclosure Statement:

Air conditioning units which use chlorinated fluorocarbon (CFC) refrigerant often have to be periodically serviced, necessitating the removal from the air conditioning unit of the CFC refrigerant prior to repair, and the subsequent return to the air conditioning unit of the refrigerant following repair. CFC refrigerants, many of which are sold by DuPont under the well known trademark FREON, have various boiling points, depending on the particular type of CFC refrigerant; some typical types of CFC refrigerants are, for example, well known in industry as R-11, R-12, R-22, R-500, and R-502, with some types being more suited to certain applications than others due to their particular boiling point, and, consequently, their operating pressures and temperatures, when used in a refrigeration or air conditioning system. R-11 refrigerant is particularly difficult to remove from an air conditioning unit, since machines which employ R-11 typically operate under a sixteen inch vacuum and a nine pound head pressure within the air conditioning unit, and thus operate at much lower pressures than air conditioning units using other refrigerants, whose operating pressures range from ten to hundreds of pounds.

For many years, it was the practice in the industry to remove CFC refrigerant from an air conditioning unit simply by releasing it into the atmosphere. Recently, however, because of concerns for the environment and possible destruction of the protective ozone layer above the earth, it has become desirable, and in many cases mandated by law, to reclaim and recycle CFC refrigerant by removing it from an air conditioning unit, cleaning the refrigerant, and then replacing the cleaned refrigerant back into the air conditioning unit, preferably without allowing the escape of any CFC refrigerant into the atmosphere during this process.

Environmental concerns, though significant, are not the only factor in favor of recycling and reusing CFC refrigerant rather than releasing it into the atmosphere. In recent years, the cost of CFC refrigerant has escalated drastically, having doubled or tripled in the past decade. For this reason, it is not only desirable to remove CFC refrigerant from an air conditioning unit prior to service, but to evacuate as much refrigerant vapor from the air conditioning unit after removal as is possible, substantially eliminating the release of any CFC vapor to the atmosphere when the air conditioning unit is opened for service. For example, a large 1200 ton air conditioning unit typically holds 2500 pounds of refrigerant. If eve three percent of the refrigerant is not evacuated from the air conditioning unit prior to opening the unit, 75 pounds of refrigerant will be released into the atmosphere, an act which is expensive as well as being harmful to the environment. Therefore, it is desirable that the capability of refrigerant removal and replacement also be accompanied by the capability of evacuating the air conditioning unit to a vacuum following refrigerant removal, as well as the capability of self-evacuating the refrigerant recovery apparatus following refrigerant replacement, so that no significant amount of refrigerant is lost when the air conditioning unit and recovery apparatus are separated and subsequently opened to the atmosphere.

It is also highly desirable that an refrigerant recovery apparatus be portable. Air conditioning systems are typically located on the roof of a building, and any refrigerant recovery apparatus must be transported to the roof in order to be attached to the air conditioning unit. Some prior refrigerant recovery machines use water or air to cool the refrigerant as it is being removed from the air conditioning unit. Those refrigerant recovery machines which require a source of water for their operation are unusable atop those buildings that lack a water supply on the roof. Those refrigerant recovery machines which use air to cool the refrigerant as it is being removed may take several days to remove the refrigerant from an air conditioning unit since temperatures may be in excess of 100 degrees Fahrenheit on the roof, imposing a great cooling burden on what must necessarily be a small, portable apparatus. Other known methods of refrigerant recovery use refrigerant from the air conditioning unit itself, cooled by the air conditioning unit, to cool the refrigerant being removed. Obviously, such methods require that the air conditioning unit be operational to remove refrigerant therefrom, and are incapable of removing refrigerant from a poorly operating air conditioning unit, even though such an inoperative unit is the most likely candidate for refrigerant removal. Thus, it is highly desirable that a refrigerant recovery apparatus or method not require the use of a source of water, and that refrigerant recovery may proceed unassisted by the air conditioning unit from which the refrigerant is being removed. Also, the cooling ability of water or air-cooled refrigeration units is constrained, as neither can cool refrigerant below the temperature of the water or air employed as a heat transfer medium. An air-cooled unit is therefore unable to cool refrigerant below the ambient air temperature which, as mentioned above, may be 100 degrees Fahrenheit or more at the site of the air conditioning unit. Similarly, a water cooled unit is unable to cool refrigerant below the temperature of its water source, which is usually either from a municipal water supply or a well-known water tower, with typical temperatures of sixty-five degrees and eighty degrees Fahrenheit, respectively. In any event, for obvious reasons, a water cooled unit is unable to cool refrigerant below the freezing point of water, approximately thirty-two degrees Fahrenheit.

A well known method for pressure testing air conditioning units is to pressurize the air conditioning unit with nitrogen and then examine the unit for leaks. An air conditioning unit cannot function if pressurized with nitrogen, so after the leaks have been located and repaired, the air conditioning unit has typically been purged to the atmosphere, releasing not only the nitrogen gas, but also refrigerant vapor. Also, the oil within the compressor of air conditioning units must be periodically changed or cleaned. Prior methods of removing the oil similarly involve pressurizing the air conditioning unit with nitrogen to force the oil out of the unit, or opening the air conditioning unit to the atmosphere. It would be highly desirable to eliminate both the use of nitrogen pressurization of the air conditioning unit to check leaks and remove oil as well as the need to open the air conditioning unit to the atmosphere to replace the oil therein, thus eliminating the subsequent release of refrigerant vapor when the nitrogen is purged from the machine or when the unit is opened to the atmosphere.

Unless a mechanism is also provided for cleaning, decontaminating, and recycling the removed refrigerant, however, replacement of the refrigerant back into the air conditioning unit would be unwise. Air conditioning units operate less efficiently if moisture is contained within their CFC refrigerant. It is therefore desirable that refrigerant moisture removal be a part of the refrigerant recycling operation.

It is also desirable for a refrigerant recovery apparatus to have the ability to wash the interior of the air conditioning unit prior to refrigerant replacement. If, for example, a motor bearing has burned out on the air conditioning unit, the interior passageways of the unit, as well as the refrigerant, will be contaminated. Were only the refrigerant to be decontaminated, and then replaced without cleaning the air conditioning unit as well, the refrigerant would then become contaminated again. A thorough treatment of the refrigerant recycling problem should address the cleaning of the air conditioning unit as well.

Some prior apparatus for refrigerant removal and processing require various couplings between the apparatus and the air conditioning unit being serviced to be moved from one point to another in order to reconfigured the apparatus for different modes of operation. This connection and disconnection of couplings provides the opportunity for CFC refrigerant release into the atmosphere, is therefore undesirable, and should preferably be minimized.

Finally, since R-11 refrigerant machines operate with refrigerant under a vacuum, over time, air will leak into such a system, and must be periodically purged, typically by the use of expensive purge pumps. It would be an added benefit if an otherwise idle refrigerant recovery system could be used to purge an air conditioning unit of air.

A preliminary patentability search in class 62, subclasses 292 and 474, produced the following patents, some of which may be relevant to the present invention: Sparano, U.S. Pat. No. 3,232,070, issued Feb. 1, 1966; Margulefsky et al., U.S. Pat. No. 4,554,792, issued Nov. 26, 1985; Scuderi, U.S. Pat. No. 4,766,733, issued Aug. 30, 1988; Manz et al., U.S. Pat. No. 4,805,416, issued Feb. 21, 1989; Manz et al., U.S. Pat. No. 4,809,520, issued Mar. 7, 1989; Lofland, U.S. Pat. No. 4,856,289, issued Aug. 15, 1989; Merritt, U.S. Pat. No. 4,903,499, issued Feb. 27, 1990; and, Proctor et al., U.S. Pat. No. 4,909,042, issued Mar. 20, 1990. A model DM-275 refrigerant recovery-recycling machine manufactured by Davco Manufacturing Co., Easton, Pa., as well as a model LV20 refrigerant recovery-recycling machine manufactured by National Refrigeration Products, Plymouth Meeting, Pa., are also known to perform retrieval of liquid CFC refrigerant from air conditioning units. While each of the above patents disclose various apparatus for removing, cleaning, or replacing chlorinated fluorocarbon (CFC) refrigerant used in an air conditioning unit, none disclose or suggest the present invention. More specifically, none of the above patents disclose or suggest a method or system for removing liquid CFC refrigerant from an air conditioning unit, cooling the refrigerant in an evaporator which itself is cooled by liquid CFC refrigerant, storing the cooled refrigerant in a storage tank, and then pumping the refrigerant back into the air conditioning unit.

Sparano, U.S. Pat. No. 3,232,070, describes an apparatus for removing refrigerant from a disabled or inoperative air conditioning unit. Refrigerant is removed in vapor form from the air conditioning unit, compressed, and stored in a tank.

Margulefsky et al., U.S. Pat. No. 4,554,792, describes a filtering unit which may be inserted in-line with an air conditioning unit. The refrigerant passing therethrough is not cooled or removed, and is only filtered.

Scuderi, U.S. Pat. No. 4,766,733, describes a refrigerant reclamation and charging unit which uses a portion of the refrigerant being removed to cool the refrigerant itself. Unlike the present invention, the Scuderi patent has no separate cooling means with its own refrigerant, limiting the Scuderi patent to use with functional air conditioning units.

Manz et al., U.S. Pat. No. 4,805,416, and Manz et al., U.S. Pat. No. 4,809,520, describe a portable apparatus for removing refrigerant, said apparatus comprising, in series, an evaporator, a compressor, and a condenser, which empty the refrigerant into a tank. The Manz patents describe a very different structure of apparatus than the present invention, and do not utilize a separate coolant to cool the removed refrigerant.

Lofland, U.S. Pat. No. 4,856,289, describes a device for recovering and purifying refrigerant, in which the refrigerant is withdrawn from an air conditioning unit, then fully converted to vapor by superheating and distillation, then compressed, condensed, and then cooled by ambient air, in contrast to the present invention which uses cooling means, having a separate coolant, to cool the withdrawn refrigerant to speed up the removal process.

Merritt, U.S. Pat. No. 4,903,499, describes an apparatus which has an expansion valve that creates a pressure differential between the air conditioning unit and the refrigerant recovery system to urge the refrigerant to exit the air conditioning unit. A water cooled pressure vessel, having an axis in alignment with the gravity vector, is provided after the expansion valve to enhance the efficiency of a condenser following the pressure vessel.

Proctor et al., U.S. Pat. No. 4,909,042, describes an automobile air conditioner charging station which removes refrigerant from the air conditioner, compresses and condenses the refrigerant, and then stores the refrigerant in a holding tank. Sensing means attached to the tank determine the amount of refrigerant which has been removed, allowing a quantity of "make-up" refrigerant to be supplied upon recharging from a second auxiliary supply tank.

SUMMARY OF THE INVENTION

A refrigerant recovery system and method is provided for removing CFC refrigerant from an air conditioning unit. In contrast to prior methods which remove refrigerant in vapor form, the present invention accelerates the refrigerant removal from an air conditioning unit by removing the refrigerant in liquid form, then cooling the removed refrigerant using cooling means. The cooled liquid refrigerant then flows into a storage tank, from which refrigerant vapor is pumped back into the air conditioning unit, thus avoiding pressure buildup in the storage tank which might impede refrigerant removal, as well as preventing liquid refrigerant retention within the air conditioning unit due to an increase in vacuum as liquid refrigerant is extracted. The cooling means for cooling the liquid refrigerant as it is removed requires no source of water, which may not be available at the site of the air conditioning unit, and uses a liquid coolant other than water to cool the refrigerant below its temperature at the air conditioning unit liquid removal port, thus creating a temperature gradient which causes the liquid refrigerant to flow from the air conditioning unit into the storage tank.

After substantially all of the refrigerant has been removed from the air conditioning unit in liquid form, the present invention may then evacuate the air conditioning unit, removing refrigerant vapor which remains within the air conditioning unit. When it is desired to replace the refrigerant back into the air conditioning unit, the present invention may return the refrigerant in liquid form back into the air conditioning unit. In contrast to prior inventions, which were restricted to use on only certain types of CFC refrigerant, it is intended that the present invention be usable on R-11, R-12, R-22, R-500, R-502, and other similar refrigerants such as the newer R-134 and R-123 refrigerants.

It is an object of the present invention to provide for moisture removal from the liquid refrigerant as it is removed from the air conditioning unit and to provide for further moisture removal as the refrigerant is replaced back into the air conditioning unit.

The present invention may additionally be configured for oil removal from an air conditioning unit, distillation of the removed refrigerant to remove impurities, pressurization of the air conditioning unit for leak checking, as well as for operation as a purge pump for the air conditioning unit. The present invention is a scalable system, and may be practiced either as a small, portable unit or as a large stationary refrigerant recovery system with correspondingly high throughput.

It is a further object of the present invention to provide a continuous closed loop system which may perform the above operations without having to disconnect the recovery apparatus from the air conditioning unit and without having to open the recovery apparatus to the atmosphere, thereby reducing or eliminating the escape of CFC refrigerant into the atmosphere.

DESCRIPTION OF THE PREFERRED EMBODIMENT

Figure 1:
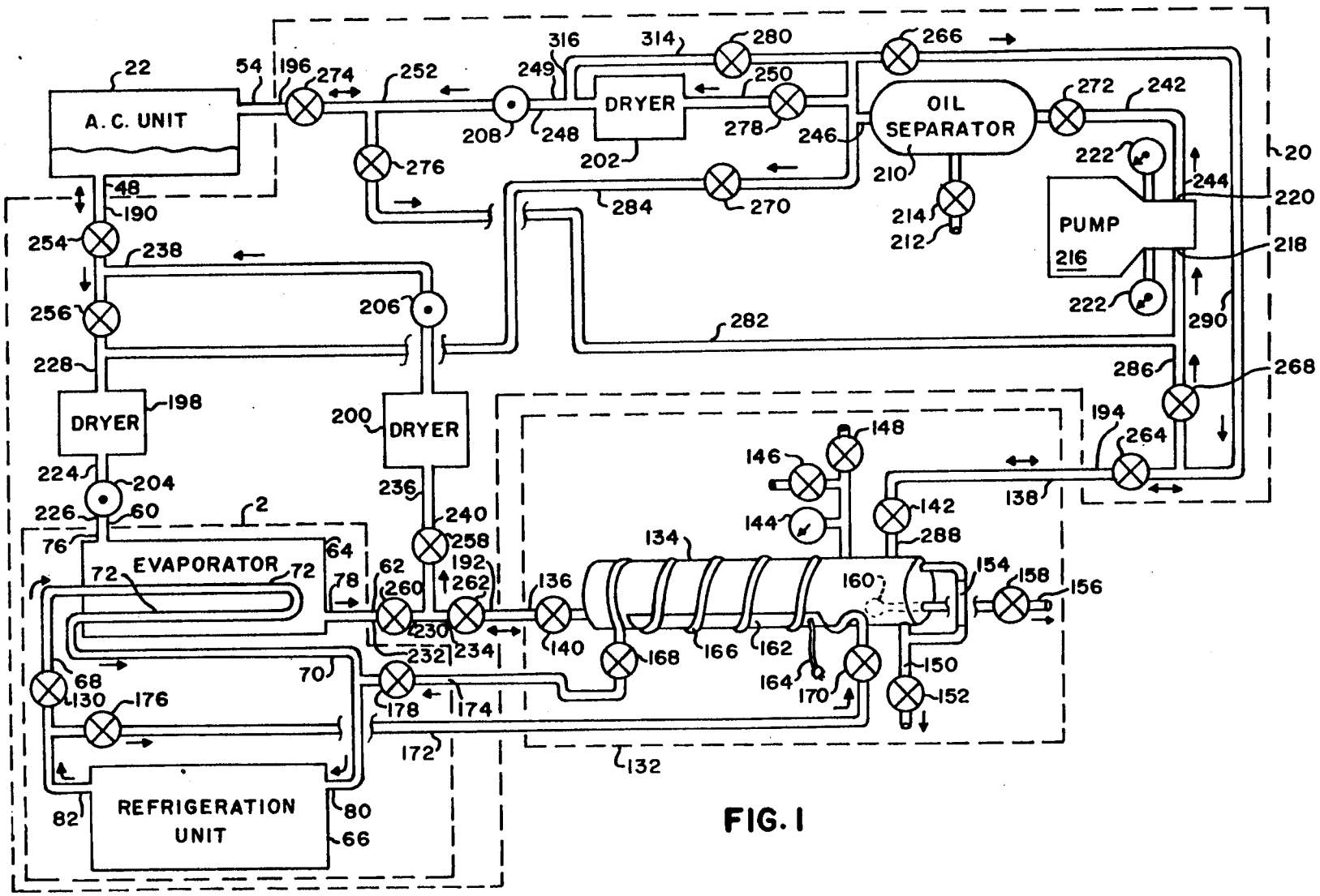
FIG. 1 is a diagram of the present invention attached to an air conditioning unit and a storage tank.

Referring to FIG. 1, the refrigerant recovery system 20 is shown attached to an air conditioning unit 22 which uses chlorinated fluorocarbon (CFC) refrigerant, said refrigerant having a liquid form and a vapor form.

Figure 3:
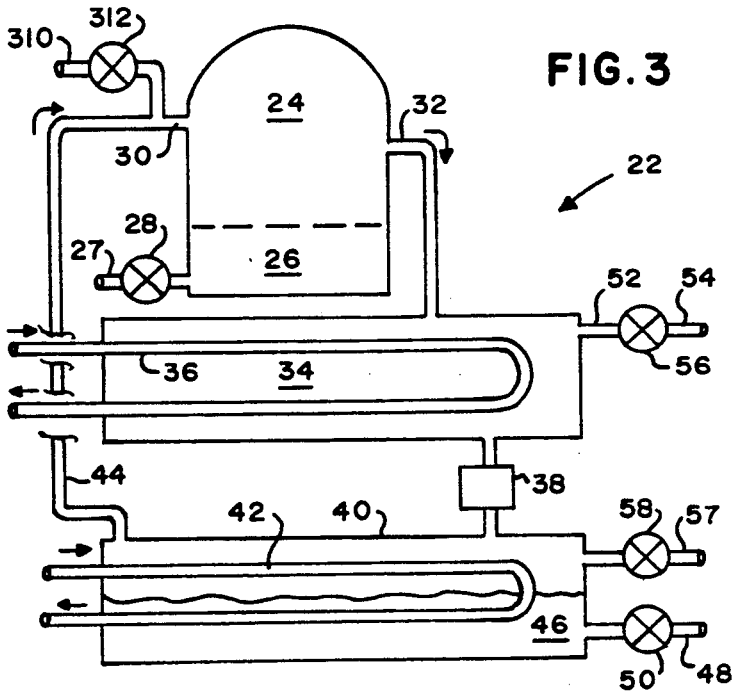
FIG. 3 is a diagram of a typical air conditioning unit such as might be serviced by the present invention.

FIG. 3 shows the typical details of such an air conditioning unit, well known to those skilled in the art, as might be used to cool a building. Air conditioning unit 22 typically comprises a compressor 24, which has an oil vat 26 containing a quantity of oil for circulation throughout the compressor, lubricating, for instance, bearings within the compressor. Oil vat 26 typically has an oil drain coupling 27, selectively in communication with oil vat 26 and sealed by oil drain valve 28, allowing contaminated oil within oil vat 26 to be changed on a periodic basis. Compressor 24 also has a compressor inlet 30 and a compressor outlet 32, and typically compresses CFC refrigerant within air conditioning unit 22 from a fifteen inch vacuum at compressor inlet 30 to a five pound pressure and approximately 160 degree Fahrenheit temperature at compressor outlet 32.

Air conditioning unit 22 also typically has a condenser 34 which receives the hot refrigerant vapor from the compressor and cools the refrigerant into its liquid form using water flowing through coils 36 which pass through the condenser. Typically, the water is supplied either directly from the municipal water supply, or from a well-known water tower. The CFC refrigerant then passes through a metering device 38, attached to condenser 34, which allows the refrigerant to expand into evaporator 40. This expansion of the CFC refrigerant cools the refrigerant to approximately forty degrees Fahrenheit, in accordance with the well known principles of thermodynamics. Water passing through evaporator coils 42 becomes chilled as it passes through the evaporator, releasing heat to the refrigerant within, and then flows throughout a building, not shown, thus cooling the building. Finally, suction return 44 returns the refrigerant to inlet 30 of compressor 24, and the cycle repeats.

Air conditioning unit 22 also typically includes a refrigerant reservoir, such as reservoir 46 in evaporator 40, for holding the CFC refrigerant in liquid form, as well as a coupling, such as coupling 48, in communication with the refrigerant reservoir, for removal from and return to the air conditioning unit of the refrigerant in liquid form, usually controlled by valve means, such as valve 50, for selectively allowing refrigerant to pass through coupling 48. Coupling 48 preferably is connected at the low point of evaporator 40 so that substantially all of the liquid refrigerant ma be removed; for certain types of air conditioning units, having a refrigerant receiver (not shown), coupling 48 will be connected instead at the low point of the receiver, in a manner well known to those skilled in the art. In most cases, air conditioning unit 22 will be provided with a liquid return coupling, such as coupling 57, sealed by valve 58, for the return of liquid refrigerant to evaporator 40 from a purge pump (not shown) which is often installed at the factory. Air conditioning unit 22 also typically includes a passageway, such as passageway 52, preferably located at the high point of the condenser 34, for holding the refrigerant in a vapor form. Since air conditioning unit 22 is a closed system, passageway 52 communicates with refrigerant reservoir 46 through, for example, metering device 38. A second coupling, such as coupling 54, in communication with passageway 52, is usually provided for removal from and return to the air conditioning unit of refrigerant in vapor form, usually controlled by valve means, such as valve 56, for selectively allowing refrigerant to pass through coupling 54.

Referring again to FIG. 1, refrigerant recovery system 20 is seen to comprise cooling means, such as cooling means 2, which has an inlet 60 and an outlet 62, for cooling the refrigerant as it passes through the cooling means from the inlet to the outlet while being removed from air conditioning unit 22. The cooling means uses a liquid coolant other than water, preferably a CFC refrigerant such as R-22, to absorb heat from the refrigerant being removed from the air conditioning unit as it passes through the cooling means from the inlet 60 to the outlet 62, thereby cooling the refrigerant being removed. The use of a coolant other than air or water allows the cooling means to preferably cool the refrigerant below thirty degrees Fahrenheit, thus creating a substantial temperature gradient between refrigerant within the air conditioning unit and refrigerant within the cooling means, speeding up refrigerant removal in a manner that will be hereinafter described. Although the refrigerant being removed from the air conditioning unit and the liquid coolant within the cooling means may be chemically similar in composition or even identical in composition, it must be understood that they are separate bodies of fluid which do not intermix; to avoid confusion, the CFC refrigerant upon which the present invention operates, i.e., removes from or replaces into the air conditioning unit, will be hereinafter referred to as "the refrigerant," while the CFC refrigerant within the cooling means will be referred to as "the coolant" to emphasize the separateness of these two refrigerants and their lack of commingling.

It is a well known principle of thermodynamics that liquid CFC refrigerant will gravitate toward the coldest part of a refrigeration system. The cooling means in the present invention, by cooling the refrigerant being removed from air conditioning unit 22 below its temperature within the air conditioning unit thus accelerates the removal process, causing the refrigerant within the air conditioning unit 22 to migrate out of air conditioning unit 22 toward cooling means 2. Some previous systems and methods for removing CFC refrigerant from an air conditioning unit use the air conditioning unit itself to cool the refrigerant being removed, but such systems and methods require that air conditioning unit 22 be operational, which the present invention does not, since cooling means 2 is separate from air conditioning unit 22, and does not rely on air conditioning unit 22 for operation. So, whatever the reason that the refrigerant is being removed from air conditioning unit, whether, for example, for repair or replacement of a faulty compressor, which will necessitate opening the closed refrigerant system within air conditioning unit 22 to the atmosphere, or for repair of an air leak within air conditioning unit 22, causing air conditioning unit 22 to lack the ability to efficiently cool refrigerant within, the presence of separate cooling means within the present invention allows the removal process to efficiently proceed, since, in contrast to previous approaches, air conditioning unit 22 is not required to be operational during the removal of refrigerant.

Figure 2:
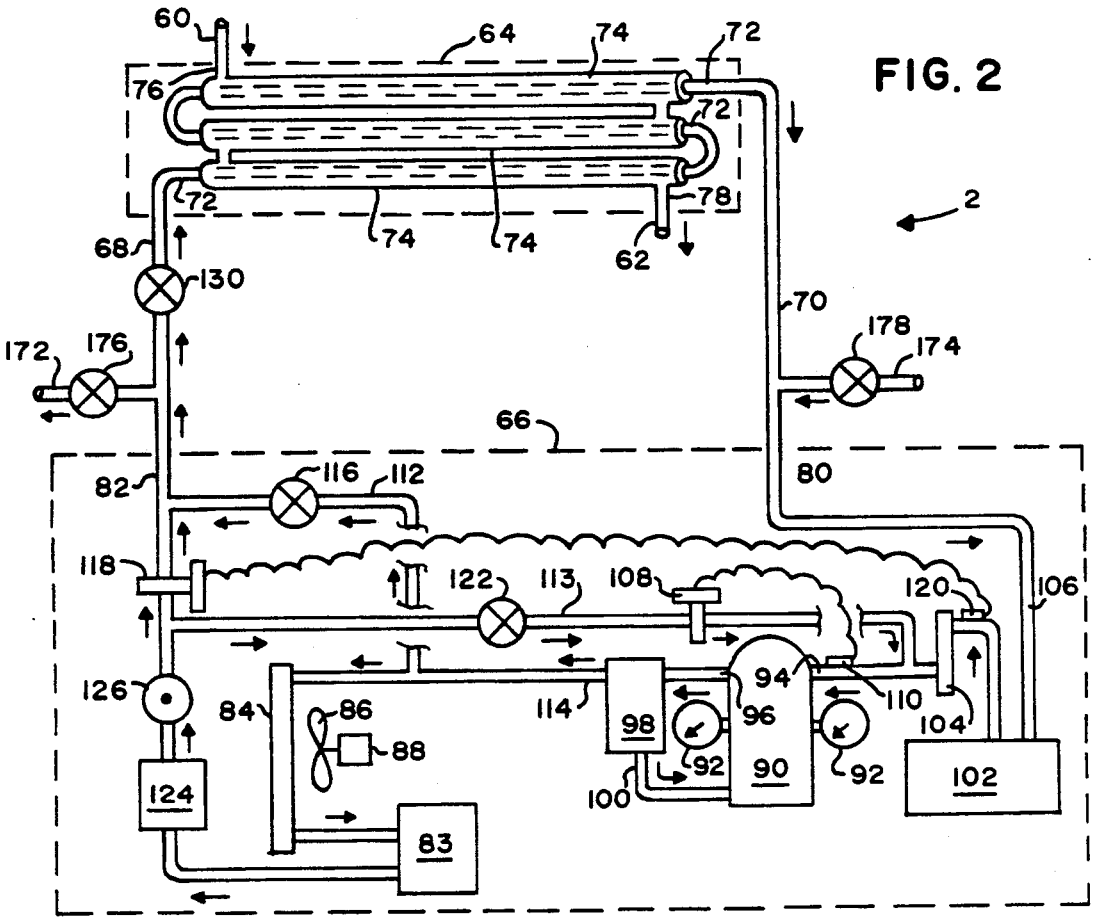
FIG. 2 is a detail of dotted area 2 shown in FIG. 1, showing the refrigeration unit of the present invention attached to the tube-in-tube evaporator.

Referring to FIG. 2, cooling means 2 is seen to preferably comprise an evaporator 64, a refrigeration unit 66, and conduit means, such as, for instance, including tubing 68 and 70, for passing a liquid coolant, preferably a CFC refrigerant such as R-22, well known to those skilled in the art, from refrigeration unit 66, through evaporator 64, and back to refrigeration unit 66.

Evaporator 64 is preferably constructed as a "tube-in-tube" evaporator, well known to those skilled in the art, having one or more inner tubes, such as tubes 72, surrounded by concentric outer tubes, such as tubes 74. Refrigerant to be cooled enters through inlet 60 of cooling means 2, then passes into evaporator 64 through evaporator inlet 76, connected to inlet 60, where it circulates around tubes 72 as it flows through tubes 74, and then passes out of evaporator 64 through evaporator outlet 78, connected to cooling means outlet 62. It will be understood by those skilled in the art that as the liquid coolant passes through evaporator 64, flowing through concentric outer tubes 74 and in close contact with inner tubes 72, it absorbs heat from the refrigerant passing through evaporator 64 in inner tubes 72 from evaporator inlet 76 to evaporator outlet 78, thereby cooling the refrigerant within evaporator inner tubes 72.

Refrigeration unit 66, having an inlet 80 and an outlet 82, cools this liquid coolant and then returns it through the conduit means to the evaporator, where the cycle is repeated. Refrigeration unit 66 is similar to other refrigeration units well known to those skilled in the art, having a receiver 83 connected to a condenser 84 which is cooled by fan 86 driven by fan motor 88, and a compressor 90. Compressor 90 preferably has gauges 92 for monitoring the pressures at compressor inlet 94 and compressor outlet 96. Compressor 90 has an oil separator 98 through which passes the hot vaporized coolant emerging from compressor outlet 96, returning oil present in the vaporized coolant to the bearings and valves within compressor 90 through oil return 100.

Refrigeration unit 66 has been adapted for use in the present invention by the addition of an accumulator 102 and a crankcase pressure regulator (C.P.R.) valve 104, both well known to those skilled in the art. Accumulator 102, interposed in suction line 106 between refrigeration unit inlet 80 and compressor inlet 94, prevents liquid coolant from returning to compressor 90 from evaporator 64. C.P.R. valve 104 is a protection device to prevent overloading compressor 90. Refrigeration unit 66 has been adapted for use in distilling refrigerant, hereinafter explained in detail, by the addition of hot gas bypass means, such as tubing 112 connecting the outlet 114 of oil separator 98 to refrigeration unit outlet 82, along with hot gas bypass valve 116 interposed therein, for selectively allowing hot vaporized coolant emerging from oil separator outlet 114 to bypass condenser 84 and pass directly to refrigeration unit outlet 82. The use of this hot gas bypass allows refrigeration unit 66 to function alternately as a heating unit, in a manner hereinafter described.

Refrigeration unit 66 has also been adapted by the addition of tubing 113 with valve 122 and de-superheating valve 108 inserted therein, protecting compressor 90 from overheating when the hot gas bypass means is used, in a manner that will now be described. When hot gas bypass valve 116 is opened, allowing vaporized coolant to circulate through evaporator 64 and back to compressor 90, valve 122, normally closed, is opened, allowing liquid refrigerant to reach de-superheating valve 108, a well-known expansion valve. De-superheating valve 108, sensing the temperature near compressor inlet 94 by sensing means 110 connected to de-superheating valve 108, allows liquid coolant to expand into the suction line leading to compressor inlet 94 if necessary, thereby cooling hot gas returning to compressor 90 as required and protecting compressor 90 from overheating.

The normal flow of coolant through refrigeration unit 66 is from inlet 80, through accumulator 102 and C.P.R. valve 104 to compressor 90, then through oil separator 98 and condenser 84 to refrigeration unit outlet 82. Refrigeration unit 66 may also include dryer means, well known to those skilled in the art, for removing moisture from the coolant used in refrigeration unit 66, such as dryer 124 interposed between receiver 83 and refrigeration unit outlet 82. A dry eye sight glass, well known to those skilled in the art, such as dry eye sight glass 126 interposed between dryer 124 and refrigeration unit outlet 82, may be used to monitor the condition of the coolant within refrigeration unit 66, typically showing a yellow indication when the coolant passing therein contains an excessive amount of moisture, and typically showing a green indication when the coolant is sufficiently dry, as preferred. Expansion valve 118, inserted between condenser 84 and refrigeration outlet 82, preferably after dryer 124, allows liquid coolant to expand as it leaves refrigeration unit 66 and passes to evaporator 64, causing the temperature of the coolant to drop to a low temperature because of the expansion, in a manner well known to those skilled in the art, thereby cooling evaporator 64 and refrigerant therein in a manner previously described. Connected to expansion valve 118 is sensing means 120, well known to those skilled in the art, which monitors the temperature of the returning coolant from evaporator 64 and appropriately causes valve 118 to regulate the flow of expanding coolant passing therethrough.

Cooling means 2 may also comprise isolation valve means, such as valve 130, for isolating evaporator 64 from refrigeration unit 66 when refrigeration unit 66 is used only to cool (or heat, when the hot gas bypass means changes the refrigeration unit into a heating unit) the storage tank, in a manner hereinafter described.

Referring again to FIG. 1, refrigerant recovery system 20 is intended for connection to a suitable refrigerant storage tank, such as storage tank 132, typically supplied at the site of air conditioning unit 22. Storage tank 132 may be as large as required to hold the refrigerant which will be removed from air conditioning unit 22 by refrigerant recovery system 20, and should be chosen, in a manner well known to those skilled in the art, to have a sufficient pressure rating to meet the intended pressure requirements during refrigerant removal and replacement, as well as during pressure testing of air conditioning unit 22.

Storage tank 132 typically comprises a tank body 134 having a first port 136 and a second port 138, each in communication with the interior of tank 132, through which refrigerant may enter and exit the tank. First port 136 is provided for allowing refrigerant in liquid form to enter and exit the tank and preferably has valve means, such as valve 140, for sealing port 136 when storage tank 132 is disconnected from refrigerant recovery system 20. Similarly, second port 138 is provided for allowing refrigerant in vapor form to enter and exit the tank and preferably has valve means, such as valve 142, for sealing port 138 when storage tank 132 is disconnected from refrigerant recovery system 20. Storage tank 132 may also have a pressure gauge 144, a pressure relief valve 146, and a manual purge valve 148, all well known to those skilled in the art. Storage tank 132 also preferably includes a drain 150 for draining water and other liquids from within the tank, in a manner that will be hereinafter described, and valve means, such as drain valve 152, for sealing the drain as desired. A sight glass, well known to those skilled in the art, such as sight glass 154, is preferably provided with tank 132, for determining the level of refrigerant within the tank, as well as for detecting the presence of water floating on the top of the refrigerant. Storage tank 132 may also have a third port 156, selectively sealed by valve means, such as valve 158. Third port 156 is connected to a float valve 160 within the tank which can return small amounts of liquid refrigerant to air conditioning unit 22 when the present invention is used to purge the air conditioning unit in a manner hereinafter described.

Storage tank 132 may be adapted for more efficient use with the present invention by the addition of a heater as well as tank cooling means for cooling the refrigerant within the tank. The tank cooling means preferably comprises tubing, such as tubing 166, coiled around tank body 134 and in close contact therewith, through which may flow a supply of coolant, preferably a CFC refrigerant. It should be noted that tubing 166 may also be used as heating means for tank 132 as will be hereinafter described for use during the distillation process or for pressure testing of the air conditioning unit, and hot gas, preferably hot vaporized CFC coolant, see below, will flow therethrough, heating tank 132 in a manner that will now be apparent. Tubing 166 preferably has sealing valve means, such as valves 168 and 170, at either end, for sealing tubing 166 when storage tank 132 is disconnected from refrigerant recovery system 20. When used to cool storage tank 132, a refrigeration unit should be connected to the ends of tubing 166 to cool and circulate coolant through the tubing. A separate refrigeration unit may be employed for this purpose, or, if preferred, refrigeration unit 66 of cooling means 2 may be employed by adapting cooling means 2 to additionally include auxiliary ports 172 and 174, preferably sealed by valve means, such as valves 176 and 178 respectively, for sealing the auxiliary ports when not in use. Auxiliary ports 172 and 174 are connected to outlet 82 and inlet 80, respectively, of refrigeration unit 66, and are for connection to the ends of tubing 166, allowing refrigeration unit 66 to perform the function of cooling tank 132 in addition to its normal function of cooling evaporator 64. This cooling of storage tank 132 accelerates the evacuation of air conditioning unit 22 in a manner that will be hereinafter described. When tank 132 is to be heated, ports 172 and 174 are again connected to the ends of tubing 166 and a hot gas, preferably hot vaporized CFC coolant from the hot gas bypass means of refrigeration unit 66, will flow through tubing 166 and heat storage tank 132. The heating of tank 132 may be augmented by the addition of a heater, which may be an electric heater well known to those skilled in the art such as heater 162, connected to a source of electricity (not shown) through power cord 164. This heating of the storage tank is used to further accelerate the refrigerant distillation process and also to pressurize air conditioning unit 22 in a manner that will be hereinafter described.

In addition to cooling means 2, previously described, refrigerant recovery system 20 additionally comprises a first coupling 190 for connection to coupling 48 of air conditioning unit 22, for removal from and return to the air conditioning unit of refrigerant in liquid form; a second coupling 192 for connection to first port 136 of storage tank 132; a third coupling 194 for connection to second port 138 of storage tank 132; and, a fourth coupling 196 for connection to coupling 54 of air conditioning unit 22, for removal from and return to the air conditioning unit of refrigerant in vapor form. All four of these couplings for connecting system 20 to air conditioning unit 22 and storage tank 132 may be installed on the ends of flexible cooling lines, well known to those skilled in the art, for ease of attachment to and removal from air conditioning unit 22 and storage tank 132.

Refrigerant recovery system 20 preferably has means for removing moisture from the refrigerant, such as dryers 198, 200, and 202, well known to those skilled in the art. These dryers may be water or acid core dryers, as desired, and may be chosen to be any size, in a manner well known to those skilled in the art, as needed to satisfy the particular requirements demanded of the present invention. Monitoring means, such as dry eye sight glasses 204, 206, and 208, well known to those skilled in the art, for monitoring the moisture condition of the refrigerant emerging from dryers 198, 200, and 202, respectively, may be placed at the outputs of the dryers as shown, typically showing a yellow indication when the coolant passing therein contains an excessive amount of moisture, and typically showing a green indication when the coolant is sufficiently dry, as preferred.

Refrigerant recovery system 20 may also have means for removing oil from the refrigerant, such as oil separator 210 having a drain 212 and means for selectively sealing the drain such as oil drain valve 214, preferably connected to a float valve (not shown) within oil separator 210 for allowing oil to drain out as required, all well known to those skilled in the art.

Refrigerant recovery system 20 additionally comprises a pump, such as purge pump 216, well known to those skilled in the art, having a suction inlet 218 and an exhaust outlet 220, for pumping refrigerant in vapor form from suction inlet 218 to exhaust outlet 220. Pressure gauges 222 for monitoring the pressures at suction inlet 218 and exhaust outlet 220 are preferably attached to pump 216. When used to evacuate air conditioning unit 22, in a manner that will be hereinafter detailed, pump 216 may be augmented, if desired, by a vacuum pump (not shown) installed in cascade with purge pump 216 at suction inlet 218, i.e., interposed in series with purge pump 216 with the vacuum pump discharging into suction inlet 216 of pump 216, allowing refrigerant recovery system 20 to evacuate air conditioning unit 22 to a deep vacuum. This augmentation of a purge pump with a vacuum pump is well known to those skilled in the art, as a vacuum pump, while capable of producing a deep vacuum, cannot efficiently operate against a high head pressure. When used to evacuate air conditioning unit 22, the purge pump is used to lower the pressure within the system to a point where the vacuum pump may then take over.

The flow of refrigerant through refrigerant recovery system 20, and the interconnection of the various elements of system 20, is preferably channeled through tubing, such as well known copper tubing commonly used in refrigeration systems. System 20 is seen to comprise tubing 224 having a first end 226 connected to inlet 60 of cooling means 2, and a second end 228; dryer 198 may be inserted in a portion of tubing 224 before inlet 60, for removing moisture from the refrigerant in a manner previously described. System 20 also comprises tubing 230 connected at a first end 232 to outlet 62 of cooling means 2, and for connection at second end 234 to second coupling 192, for emptying the refrigerant into storage tank 132. Tubing 236, having a first end 238 for connection to first coupling 190 of system 20 and a second end 240 for connection to second coupling 192 of system 20, is provided for return to air conditioning unit 22 of refrigerant in liquid form, and may have dryer 200 inserted in a portion thereof for removing moisture from the refrigerant passing therethrough. Tubing 242, having a first end 244 connected to exhaust outlet 220 of pump 216, has a second end 246 which may be appropriately configured to direct the refrigerant emerging from pump 216 in a manner that will be hereinafter described. System 20 may also comprise tubing 248, having a first end 250 for connection to the second end of tubing 242, and a second end 252 for connection to fourth coupling 196 of system 20. Oil separator 210, previously described, may be inserted in a portion of tubing 242 for removing oil from the refrigerant flowing through tubing 242, and dryer 202, also previously described, may be inserted in a portion of tubing 248 for removing moisture from the refrigerant passing therethrough.

Refrigerant recovery system 20 also preferably comprises configuration mean for selectively configuring system 20 into a set of configurations. This set of configurations may include a refrigerant removal configuration, a refrigerant replacement configuration, an evacuate/purge configuration, and other configurations that will be hereinafter described in detail. In the preferred embodiment of system 20, the configuration means comprises valves, such as valves 254, 256, 258, 260, 262, 264, 266, 268, 270, 272, 274, 276, 278, and 280, which route the flow of refrigerant throughout system 20 and selectively couple various elements of system 20 to various other elements, in a manner that will now be described. It should be noted that valves 254, 262, 264, and 274 also serve to seal the various couplings of system 20 when system 20 is disconnected from air conditioning unit 22 and storage tank 132, preventing the unwanted discharge of refrigerant into the atmosphere and keeping air from contaminating refrigerant within system 20. The detailed operation of the present invention, the interconnection of system 20 by the configuration means, and the features of the present invention are best understood by a discussion explaining the various configurations. It will be understood, as the explanation progresses, that some features and configurations may be eliminated for simplicity, if desired, or that the machine may be statically configured for a particular operation, by simply removing the unused elements and valves in a manner that will become apparent to those skilled in the art.

The first configuration is the evacuate/purge configuration, wherein system 20 is used to purge air conditioning unit 22 of air, and optionally, to evacuate air conditioning unit 22 to a deep vacuum. In this configuration, coupling 196 of system 20 is connected to coupling 54 of air conditioning unit 22, and coupling 192 of system 20 is connected to first port 136 of storage tank 132. Valves 254, 56, 258, 264, 266, 268, 278, and 280 on system 20 are closed, while valves 260, 262, 270, 272, 274, 276, and 130 are open. Also, oil separator drain valve 214 is closed. On storage tank 132, valve 140 is open, While valves 142, 152, and 158 are closed. Also, unless otherwise noted, in this configuration, as well as all configurations that will be hereinafter discussed, pressure relief valve 146 and manual purge valve 148 on storage tank 132 will be closed, the normal condition for those valves. To increase the efficiency and speed of operation of system 20, storage tank 132 may be additionally cooled by tank cooling means, previously described, such as by attaching a refrigeration unit to coiled tubing 166 and opening valves 168 and 170, allowing CFC coolant to cool tank 132, or, if desired, the ends of tubing 166 may be attached to auxiliary ports 172 and 174 of refrigeration unit 66, and valves 176 and 178 opened, allowing refrigeration unit 66 to cool storage tank 132 in addition to simultaneously cooling evaporator 64.

Also, within refrigeration unit 66, hot gas bypass valve 116 will be closed, allowing refrigeration unit 66 to operate in its normal capacity as a refrigeration unit; unless otherwise stated, valve 116 will be assumed closed in all the following configurations.

Figure 4:
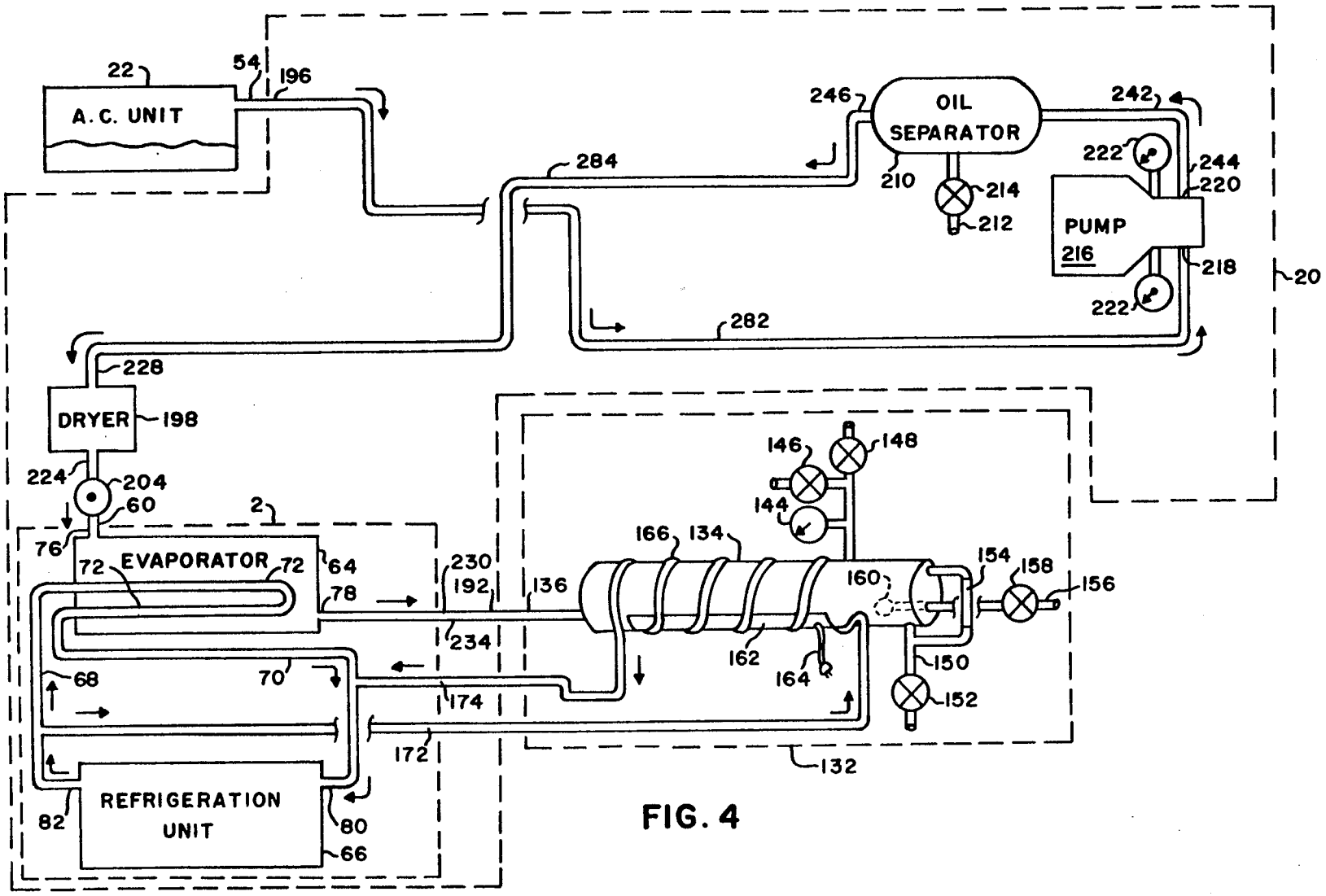
FIG. 4 is a diagram of the present invention configured to purge an air conditioning unit, with valves and inactive elements omitted for clarity.

Thus configured in the evacuate/purge configuration, system 20 is seen to have the topology shown in FIG. 4, where all valves and inactive elements have been removed for clarity. In this configuration, suction inlet 218 of pump 216 is connected to fourth coupling 196 through valves 274, 276 and tubing 282; second end 246 of tubing 242 is connected to second end 228 of tubing 224 through valve 270 and tubing 284; and second end 234 of tubing 230 is connected to second coupling 192 through valve 262. Also, pressure relief valve 146 on tank 132 will have been selected, in a manner well known to those skilled in the art, to match the particular refrigerant being purged. It should be noted that system 20 will operate in the evacuate/purge configuration while air conditioning unit 22 is either operational or not, as desired.

Refrigeration unit 66 is now started in its cooling cycle, with hot gas bypass valve 116 closed, and is used to cool down evaporator 64 and storage tank 132. Refrigerant vapor will leave air conditioning unit 22 through couplings 54 and 196, to suction inlet 218 of purge pump 216. Purge pump 216 will compress the refrigerant and cause it to pass through oil separator 210, which will remove oil from the refrigerant passing therethrough. Oil which accumulates in the oil separator can be drained by opening drain valve 214; the float valve, previously mentioned, within oil separator 210, will allow oil to flow out of oil separator as required. This extracted oil should then be properly disposed of, using approved environmentally safe procedures.

Refrigerant vapor will then leave oil separator 210 and flow through dryer 198, which will remove moisture from the vapor. The condition of the refrigerant may be monitored, if desired, using dry eye sight glass 204. The refrigerant then passes through cold evaporator 64 where it will be condensed into a liquid, typically at a temperature below 35 degrees Fahrenheit. This condensation of the refrigerant into a liquid will separate air mixed with the refrigerant vapor from the refrigerant, as the air will not condense with the refrigerant since the refrigerant has a much higher boiling point than does air. The liquid refrigerant, and possibly any air which was mixed with the vapor refrigerant, then travels into storage tank 132 through coupling 192 and first port 136, where it may remain. If air was originally mixed with the vapor refrigerant, then pressure will build up within storage tank 132 as the purge operation proceeds, and will be released to the atmosphere through pressure relief valve 146, or, alternatively, through manual purge valve 148 by an operator monitoring pressure gauge 144.

It should be noted that if the present invention is not needed for other functions, it may be installed in the evacuate/purge configuration on an R-11 air conditioning unit and left until needed, operating as a permanent purge pump by returning the small amounts of liquid which flow into tank 132 to air conditioning unit 22 through float valve 160, valve 158, and third port 156 of tank 132 by connecting third port 156 to the low side of the chiller of air conditioning unit 22 through coupling 57 and valve 58 which are typically provided for use with a stand-alone purge pump. While installed as a permanent purge pump, the present invention still remains available for other functions without disconnecting couplings. Since substantially all of the liquid refrigerant will be returned to air conditioning unit 22 when used in this manner, a small storage tank 132 may be used, as no significant amount of refrigerant will need to accumulate in the tank. If a large storage tank is used and the tank is well cooled by tank cooling means, previously described, very little refrigerant vapor will be lost when purging air through relief valve 146 or manual purge valve 148, as substantially all of the refrigerant vapor will condense into liquid form in the bottom of the tank. By scaling the size of the components of system 20, any desired processing capacity and speed can be readily achieved. It has been found that a ½ horsepower purge pump, combined with a two horsepower refrigeration unit, can typically purge a 250 ton R-11 air conditioning unit in about twenty minutes.

If it is desired to evacuate air conditioning unit 22 to a deep vacuum, a vacuum pump can be installed in cascade with pump 216 at suction inlet 218 as previously described. It should be noted that the tank cooling means for cooling storage tank 132, if present, assists in the evacuation process as it lowers the head pressure against which pump 216 must pump, especially on R-12, R-22, R-500, and R-502 refrigerant air conditioning units, as it cools the refrigerant within tank 132, reducing the vapor pressure therein in a manner well known to those skilled in the art.

A second configuration for refrigerant recovery system 20 is the refrigerant removal configuration, wherein system 20 is used to remove liquid refrigerant from air conditioning unit 22. In this configuration, couplings 190 and 196 of system 20 are connected to couplings 48 and 54, respectively, of air conditioning unit 22, and couplings 192 and 194 of system 20 are connected to first and second ports 136 and 138, respectively, of storage tank 132. Valves 258, 266, 270, 276, and 280 on system 20 are closed, while valves 254, 256, 260, 262, 264, 268, 272, 274, 278, and 130 are open. Also, oil separator drain valve 214 is closed. On storage tank 132, valves 140 and 142 are open, while valves 152 and 158 are closed. To increase the efficiency and speed of operation of system 20, storage tank 132 may be additionally cooled by tank cooling means, in a manner previously described, such as by attaching a refrigeration unit to coiled tubing 166 and opening valves 168 and 170, allowing CFC coolant to cool tank 132, or, if desired, the ends of tubing 166 may be attached to auxiliary ports 172 and 174 of refrigeration unit 66, and valves 17 and 178 opened, allowing refrigeration unit 66 to cool storage tank 132.

Figure 5:
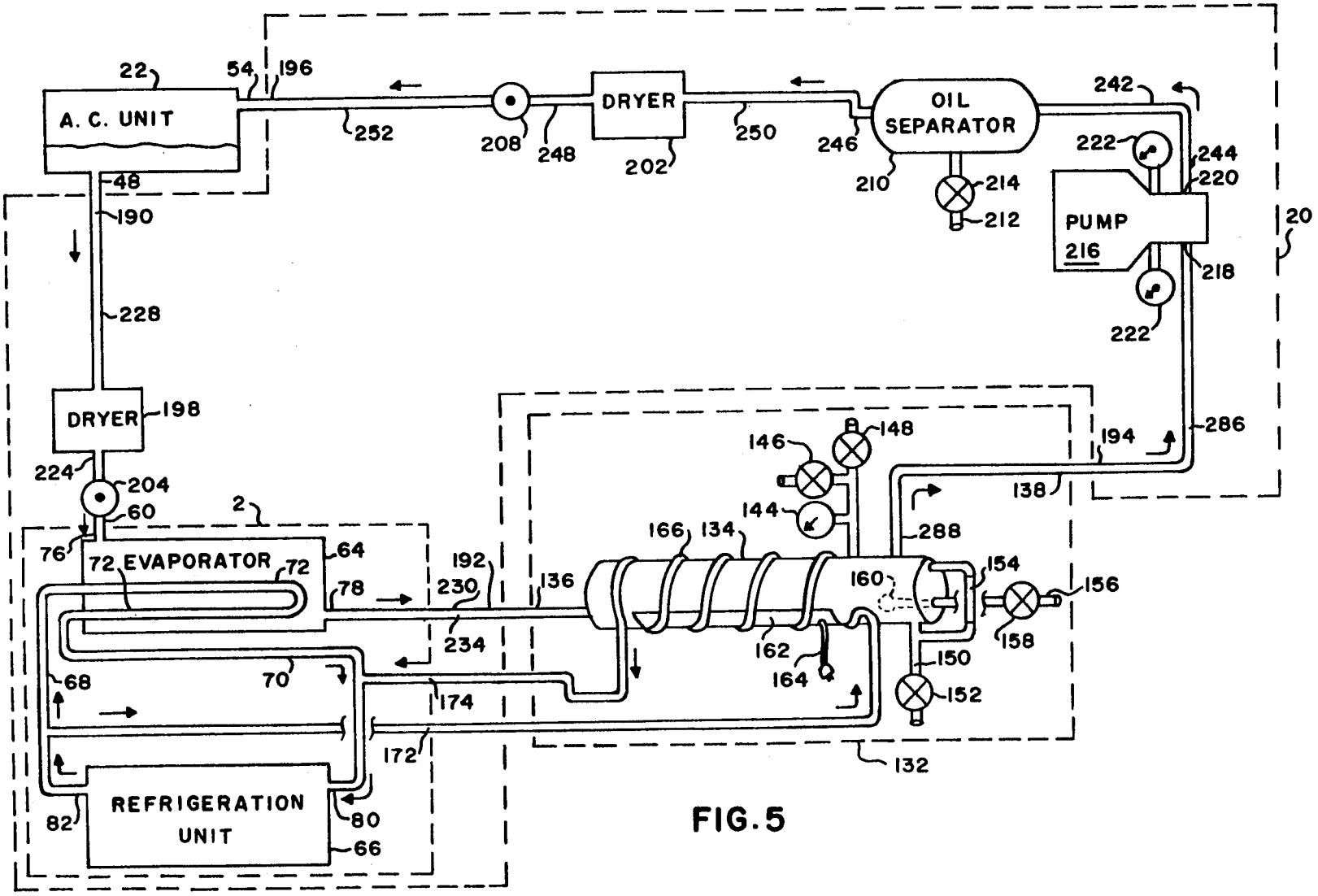
FIG. 5 is a diagram of the present invention configured to remove refrigerant from an air conditioning unit, with valves and inactive elements omitted for clarity.

Thus configured in the refrigerant removal configuration, system 20 is seen to have the topology shown in FIG. 5, where all valves and inactive elements have been removed for clarity. In this configuration, second end 228 of tubing 224 is connected to first coupling 190 of system 20 through valves 256 and 254; second end 234 of tubing 230 is connected to second coupling 192 through valve 262; suction inlet 218 of pump 216 is connected to third coupling 194 through valves 268, 264 and tubing 286; second end 246 of tubing 242 is connected to first end 250 of tubing 248 through valve 278; and second end 252 of tubing 248 is connected to fourth coupling 196 through valve 274.

Refrigeration unit 66 is now started in its cooling cycle, with hot gas bypass valve 116 closed, and is used to cool down evaporator 64 and storage tank 132. Purge pump 216 is also energized. Liquid refrigerant will leave air conditioning unit 22 through couplings 48 and 190, and pass through dryer 198 where moisture removal begins. The refrigerant then flows through dry eye sight glass 204, allowing the moisture content of the refrigerant to be monitored, and through cold evaporator 64, where it is cooled to typically thirty five degrees Fahrenheit, into storage tank 132 through coupling 192 and first port 136, where it is then further cooled by storage tank cooling means, previously described. This cooling of the refrigerant in the evaporator and storage tank accelerates the removal of refrigerant from air conditioning unit 2 by employing the well known principle of thermodynamics that liquid CFC refrigerant will gravitate toward the coldest part of a refrigeration system, causing liquid refrigerant to leave air conditioning unit 22 in a preference for cold evaporator 64 and storage tank 132.

To keep the refrigerant flowing from air conditioning unit 22 into storage tank 132, refrigerant vapor within storage tank 132 is pumped from within tank 132 out second port 138 and coupling 194 by purge pump 216. Tubing 288, connecting second port 138 to the interior of tank body 134, preferably has a dip tube, not shown, well known to those skilled in the art, extending into the storage tank so the tank cannot be over-filled while refrigerant is being removed from air conditioning unit 22. Purge pump 216, pumping the refrigerant vapor from suction inlet 218 to exhaust outlet 220, forces the refrigerant vapor to flow through oil separator 210 and dryer 202, which further removes moisture from the refrigerant, monitored by dry eye sight glass 208, and back into the air conditioning unit through couplings 196 and 54. The refrigerant vapor flowing back into air conditioning unit 22 helps force liquid refrigerant within the air conditioning unit out coupling 48, until substantially no liquid refrigerant remains within the air conditioning unit. The usual safety precautions dictate that the pressure within storage tank 132 should be monitored, and care taken that tank 132 is not allowed to exceed its pressure rating. When substantially al liquid refrigerant has been removed from air conditioning unit 22, refrigerant recovery system 20 should be reconfigured into the evacuate/purge configuration previously described, and air conditioning unit 22 should then be evacuated, possibly to a deep vacuum as previously described, thereby removing substantially all the remaining refrigerant which remains therein in vapor form. At this point, valves 74 and 4 may be closed, sealing couplings 196 and 190, allowing air conditioning unit 22 to be disconnected from refrigerant recovery system 20 without allowing any substantial amount of refrigerant to escape into the atmosphere, and allowing air conditioning unit 22, now emptied of substantially all refrigerant, to be repaired or otherwise serviced.

A third configuration for refrigerant recovery system 20 is the refrigerant replacement configuration, wherein system 20 is used to put liquid refrigerant back into air conditioning unit 22. In this configuration, couplings 190 and 196 of system 20 are connected to couplings 48 and 54, respectively, of air conditioning unit 22, and couplings 192 and 194 of system 20 are connected to first and second ports 136 and 138, respectively, of storage tank 132. Valves 256, 260, 268, 270, 278, and 280 on system 20 are closed, while valves 254, 258, 262, 264, 266, 272, 274, and 276 are open. Also, oil separator drain valve 214 is closed. On storage tank 132, valves 140 and 142 are open, while valves 152 and 58 are closed. Also, refrigeration unit 66 is turned off in the refrigerant replacement configuration since, as previously explained, were it to cool evaporator 64 or storage tank 132, they would tend to hold refrigerant, which tends to flow to the coldest point of a refrigeration system. Since neither refrigeration unit 66 nor the tank cooling means for storage tank 132 are used in this configuration, the state of valves 130, 176, and 178 within cooling means 2, as well as that of valves 168 and 170 on storage tank 132, does not matter, as will now be apparent, but, for convenience, and to ensure that coolant does not escape into the atmosphere if storage tank 132 is disconnected from system 20, these valves will preferably be closed.

Figure 6:
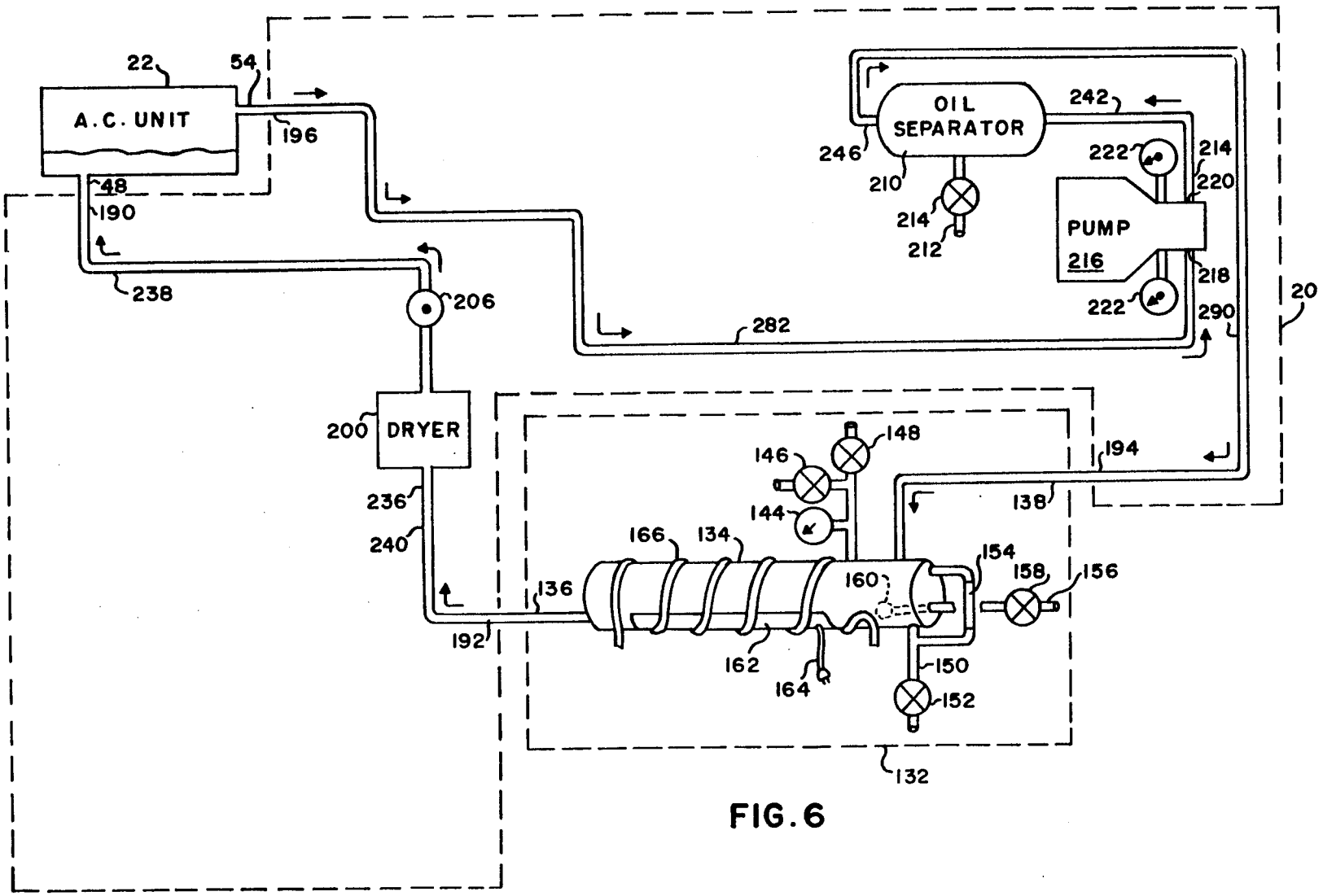
FIG. 6 is a diagram of the present invention configured to return refrigerant to an air conditioning unit, with valves and inactive elements omitted for clarity.

Thus configured in the refrigerant replacement configuration, system 20 is seen to have the topology shown in FIG. 6, where all valves and inactive elements have been removed for clarity. In this configuration, first end 238 of tubing 236 is connected to first coupling 190 of system 20 through valve 254; second end 240 of tubing 236 is connected to second coupling 192 through valves 258 and 262; second end 246 of tubing 242 is connected to third coupling 194 through tubing 290 and valves 266 and 264; and, suction inlet 218 of pump 216 is connected to fourth coupling 196 through tubing 282 and valves 276 and 274.

Refrigerant replacement into air conditioning unit 22 occurs as refrigerant vapor is suctioned from air conditioning unit 22 through couplings 54 and 196 into suction inlet 218 of pump 216, then forced through oil separator 210, coupling 194 and second port 138 into tank 132, thereby forcing liquid refrigerant from tank 132 through port 136 and coupling 192, through dryer 200, which removes moisture from the refrigerant, through dry eye sight glass 206 monitoring the condition of the refrigerant, and back into air conditioning unit 22 through couplings 190 and 48.

After substantially all of the liquid refrigerant has been replaced into air conditioning unit 22, remaining refrigerant vapor within system 20 may be then drawn back into air conditioning unit 22 by closing valves 254 and 274, as well as valves 50 and 56 on air conditioning unit 22 (see FIG. 1 and 3), moving coupling 196 to suction coupling 310 on the "low side" of air conditioning unit 22, typically at compressor suction inlet 30 of air conditioning unit 22, and then opening valve 274 on system 20 and suction valve 312 on air conditioning unit 22 while air conditioning unit 22 is operating. Valves 256, 260, 268, 278, and 280 may now be opened, and air conditioning unit 22 will remove substantially all remaining refrigerant from within system 20.

Alternatively, system 20 may be self-evacuated by closing valves 254, 266, 270, and 276, while opening valves 256, 258, 260, 262, 264, 268, 272, 274, 278, and 280, as well as storage tank valves 140 and 142. Coupling 196 should be connected to compressor suction inlet 30 of air conditioning unit 22 through suction coupling 310 and suction valve 312, in the manner mentioned above. Purge pump 216 is then operated until substantially all refrigerant vapor within system 20 has been forced out exhaust outlet 220 of pump 216 into oil separator 210. Preferably, the length of tubing from pump 216 through oil separator 210 to coupling 196 should be as short as possible, so that very little refrigerant vapor remains therein, as this is the only portion of system 20 that cannot be evacuated by system 20 on its own. At this point, purge pump 216 may be stopped, and air conditioning unit 22 may be used to evacuate oil separator 210 through couplings 310 and 196, valve 274, dryer 202, and valve 278. In this manner, very little refrigerant will be lost from air conditioning unit 22, and substantially all refrigerant that was removed from the air conditioning unit will be replaced back into the air conditioning unit. Typically, R-12, R-22, R-500, and R-502 air conditioning units, such as air conditioning unit 22, will have a suction coupling 310 as described above; R-11 air conditioning units may not. For such an air conditioning unit 22 without a suction coupling 310, connection of coupling 196 may instead be made to factory installed coupling 57 in communication with evaporator 4 and reservoir 46 through valve 5 shown in FIG. 2.

It should be noted that air conditioning unit 22 may be washed while its refrigerant is being cleaned by repeatedly removing and replacing the refrigerant, circulating the refrigerant back and forth into and out of air conditioning unit 22 by successively iterating refrigerant recovery system 20 between the refrigerant removal configuration and the refrigerant replacement configuration, with each iteration removing successively more moisture and oil from the refrigerant as it passes through the oil separator and dryers. It also should be noted that the selection of attachment points on air conditioning unit 22 for couplings 196 and 190 may be varied, and alternative placements of those couplings may be used to wash various parts of air conditioning unit 22 as liquid refrigerant is extracted from and replaced into air conditioning unit 22 in successive iterations of removal and replacement, as previously described.

Occasionally, an air conditioning unit, such as air conditioning unit 22, may have to be serviced which has suffered a water leak, allowing water to escape into the condenser or the evaporator, thus contaminating the refrigerant within the air conditioning unit. The present invention may be used in the refrigerant removal configuration to remove substantially all the contaminated refrigerant from the air conditioning unit, allowing the air conditioning unit to be then disconnected from the refrigerant recovery system and repaired. While the air conditioning system is being repaired, the contaminated refrigerant will sit in storage tank 132 and the water mixed therein will rise to the top of the refrigerant, in a manner well known to those skilled in the art; the separation line between the water and the liquid refrigerant may then be observed through sight glass 154 on storage tank 132. When the refrigerant is put back into repaired air conditioning unit 22 using the refrigerant replacement configuration, careful monitoring of the separation line between the water and the liquid refrigerant through sight glass 154, as the separation line lowers due to the removal of liquid refrigerant from storage tank 132, can allow the refrigerant replacement process to proceed until the separation line is at the bottom of sight glass 154, and therefore, at the bottom of tank body 132 as well, indicating that substantially all the refrigerant has been replaced into air conditioning unit 22. At this point, refrigerant recovery system 20 may be stopped, halting the refrigerant replacement process, and the water may be drained from storage tank 132 through drain 150 by opening drain valve 152 on storage tank 132. Moisture which is removed from tank 132 in vapor form with the refrigerant as it is replaced into air conditioning unit 22 will be substantially removed from the refrigerant by dryer 200, in a manner previously described.

A fourth configuration for refrigerant recovery system 20 is the oil removal configuration, wherein system 20 is used to remove the oil from the oil vat within the compressor of air conditioning unit 22. In this configuration, coupling 196 of system 20 is connected to coupling 54 of air conditioning unit 22, as in the previous configurations, but coupling 190 is connected to oil drain coupling 27 (see also FIG. 3) of air conditioning unit 22. Also, couplings 192 and 194 of system 20 are Connected to first and second ports 136 and 138, respectively, of storage tank 132. Valves 258, 266, 270, 276, and 280 on system 20 are closed, while valves 254, 256, 260, 262, 264, 268, 272, 274, and 278 are open. Also, oil separator drain valve 214 is closed. On storage tank 132, valves 140 and 142 are open, while valves 152 and 158 are closed. Refrigeration unit 66 is not used in the refrigerant replacement configuration, and should be turned off; similarly, the tank cooling means for storage tank 132 is also not used in this configuration, so the state of valves 130, 176, and 178 within cooling means 2, as well as that of valves 168 and 170 on storage tank 132 does not matter, as will now be apparent, but, for convenience, and to ensure that coolant does not escape into the atmosphere if storage tank 132 is disconnected from system 20, these valves will preferably be closed.

Figure 7:
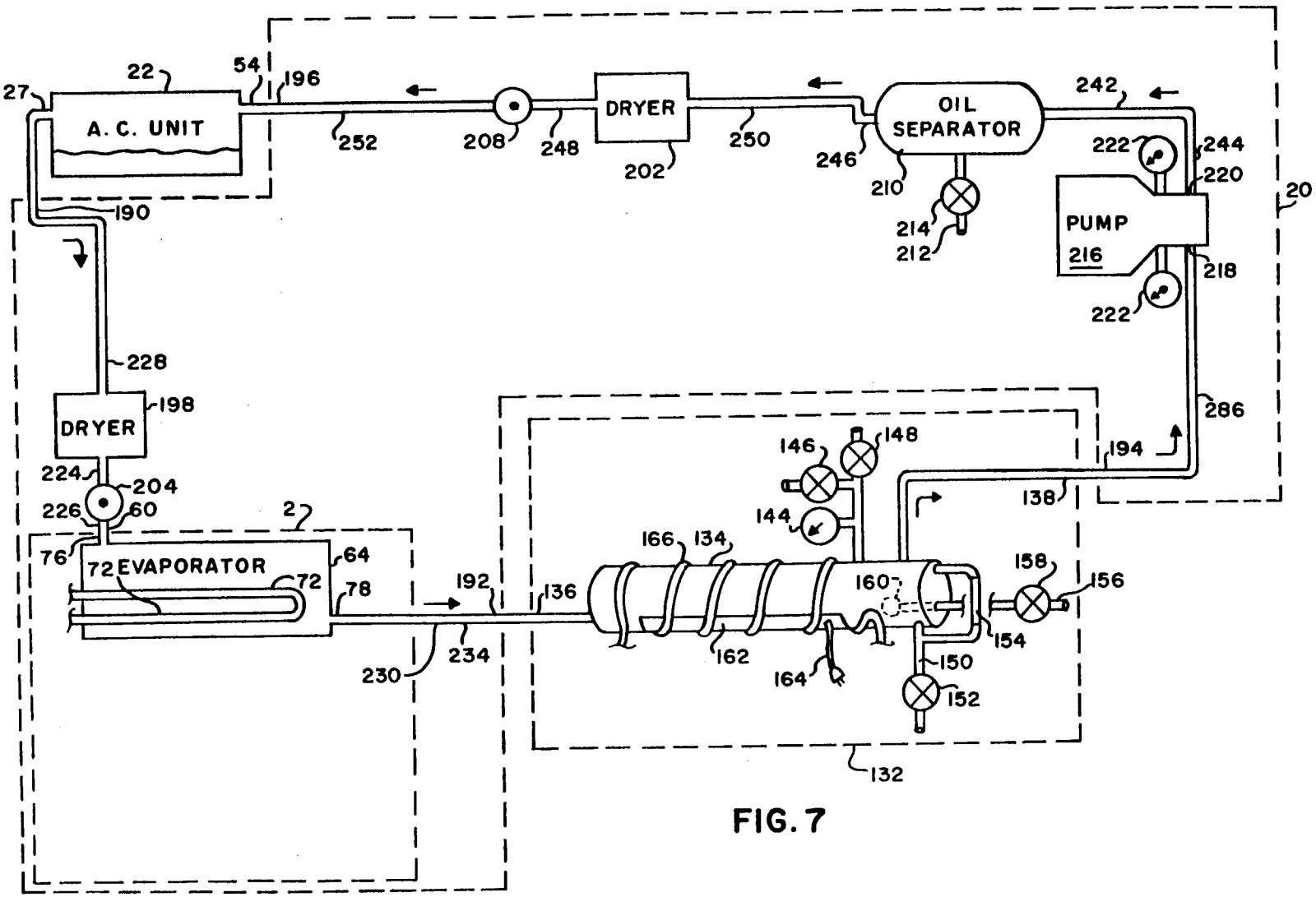
FIG. 7 is a diagram of the present invention configured to remove oil from an air conditioning unit, with valves and inactive elements omitted for clarity.

Thus configured in the oil removal configuration, system 20 is seen to have the topology shown in FIG. 7, where all valves and inactive elements have been removed for clarity. In this configuration, second end 228 of tubing 224 is connected to first coupling 190 of system 20 through valves 256 and 254; second end 234 of tubing 230 is connected to second coupling 192 through valve 262; suction inlet 218 of pump 216 is connected to third coupling 194 through valves 268, 264 and tubing 286; second end 246 of tubing 242 is connected to first end 250 of tubing 248 through valve 278; and second end 252 of tubing 248 is connected to fourth coupling 196 through valve 274. It will be observed that this topology, with the exception of the connection between coupling 190 and air conditioning unit 22, is the same as that present in the refrigerant removal configuration, except that refrigeration unit 66 is not running while oil removal proceeds. Also, in this oil removal configuration, it will be understood that evaporator 64 merely functions as a conduit to connect first end 226 of tubing 224 to second coupling 192 through tubing 234.

Oil is removed from air conditioning unit 22 by flowing from oil vat 26 (see FIG. 3), out oil drain coupling 27 and through coupling 190, through dryer 198 which removes moisture, through dry eye sight glass 204 and evaporator 64, which acts as a conduit to second coupling 192, then through couplings 192 and 136 into storage tank 132. Pump 216 suctions refrigerant vapor from storage tank 132, forcing it out through oil separator 210, dryer 202 and dry eye sight glass 208, and back into air conditioning unit 22, thus preventing a suction from developing within air conditioning unit 22 which might tend to hold the oil within. Once removed, the oil may be tested using an acid test kit, well known to those skilled in the art. If the oil is found to be satisfactory, then it may be replaced back into air conditioning unit 22 using an oil replacement configuration, with the same topology as the refrigerant replacement configuration, previously described, except that first coupling 190 will remain connected to oil drain coupling 27, and oil, not liquid refrigerant, will be forced from storage tank 132 back into oil vat 26 of air conditioning unit 22.

A fifth configuration for refrigerant recovery system 20 is the refrigerant distillation configuration, wherein system 20 is used to distill impurities from the refrigerant. In this configuration, couplings 190 and 196 of system 20 are connected to couplings 48 and 54, respectively, of air conditioning unit 22, and couplings 192 and 194 of system 20 are connected to first and second ports 136 and 138, respectively, of storage tank 132. Valves 258, 266, 270, 276, and 280 on system 20 are closed, while valves 254, 256, 260, 262, 264, 268, 272, 274, 278, and 130 are open. Also, oil separator drain valve 214 is closed. On storage tank 132, valves 140 and 142 are open, while valves 152 and 158 are closed. Referring to FIG. 2, cooling means 2 is not used in the distillation process as a cooling means, but rather as a heating means, by opening hot gas bypass valve 116 within refrigeration unit 66, allowing the hot coolant gas which emerges from compressor outlet 96 through oil separator 98 to flow into inner tubes 72 of tube-in-tube evaporator 64. This hot coolant gas, typically 160 degrees Fahrenheit, heats the evaporator and causes the refrigerant passing therethrough from evaporator inlet 76 to evaporator outlet 78 to boil into a vapor. To accelerate the distillation process, this hot coolant gas may also be used to heat storage tank 132. To accomplish the heating of tank 132, the ends of coiled tubing 166 may be attached to auxiliary ports 172 and 174 of refrigeration unit 66, here configured as a heating unit in a manner previously described, and valves 176 and 178 opened, allowing hot coolant gas to flow through tubing 166, thereby heating tank 132.

Figure 8:
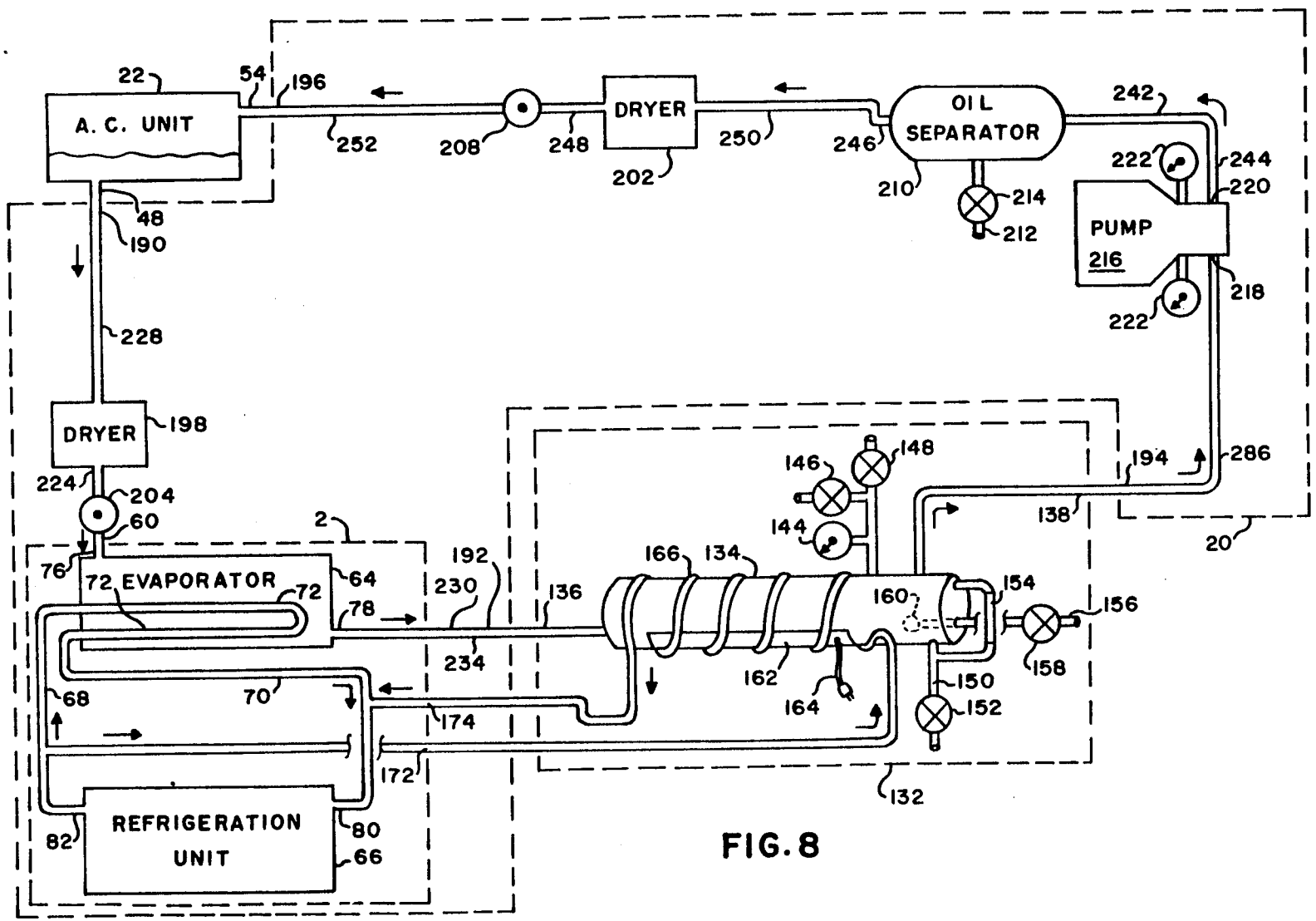
FIG. 8 is a diagram of the present invention configured to distill the refrigerant in an air conditioning unit, with valves and inactive elements omitted for clarity.

Thus configured in the refrigerant distillation configuration, system 20 is seen to have the topology shown in FIG. 8, where all valves and inactive elements have been removed for clarity. In this configuration, second end 228 of tubing 224 is connected to first coupling 190 of system 20 through valves 256 and 254; second end 234 of tubing 230 is connected to second coupling 192 through valve 262; suction inlet 218 of pump 216 is connected to third coupling 194 through valves 268, 264 and tubing 286; second end 246 of tubing 242 is connected to first end 250 of tubing 248 through valve 278; and second end 252 of tubing 248 is connected to fourth coupling 196 through valve 274. It should be noted that this topology is substantially the same as that used in the refrigerant removal configuration, except that hot gas bypass valve 116 within refrigeration unit 66 is opened, allowing evaporator 64 to heat, not cool, the refrigerant, and that storage tank 132 is not cooled, as it may be in the refrigerant removal configuration, but instead may be heated, as described above.

The distillation process proceeds as the liquid refrigerant flows out of air conditioning unit 22 in liquid form through couplings 48 and 190, through dryer 198, which removes moisture, and then through dry eye sight glass 204 which monitors the moisture removal. The refrigerant then flows through the evaporator, where it is heated into a vapor by the hot coolant gasses from refrigeration unit 66, and into storage tank 132. Pump 216 then pulls the refrigerant vapor out of tank 132, leaving most oil and moisture, which previously contaminated the refrigerant, within the storage tank in liquid form. The refrigerant vapor then passes out of pump 216, through oil separator 210 which removes oil remaining in the refrigerant vapor, through dryer 202 which removes moisture remaining in the refrigerant vapor, through dry eye sight glass 208, allowing the moisture content of the refrigerant vapor to be monitored, and back into air conditioning unit 22 through couplings 196 and 54. Throughout the distillation process, care should be taken to monitor the pressure within storage tank 132 and to stay within the release pressure of pressure relief valve 146. If desired, the distillation process may be further accelerated by additionally heating storage tank 132 by a heater, which may be an electric heater well known to those skilled in the art such as heater 162, connected to a source of electricity (not shown) through power cord 164.

Figure 9:
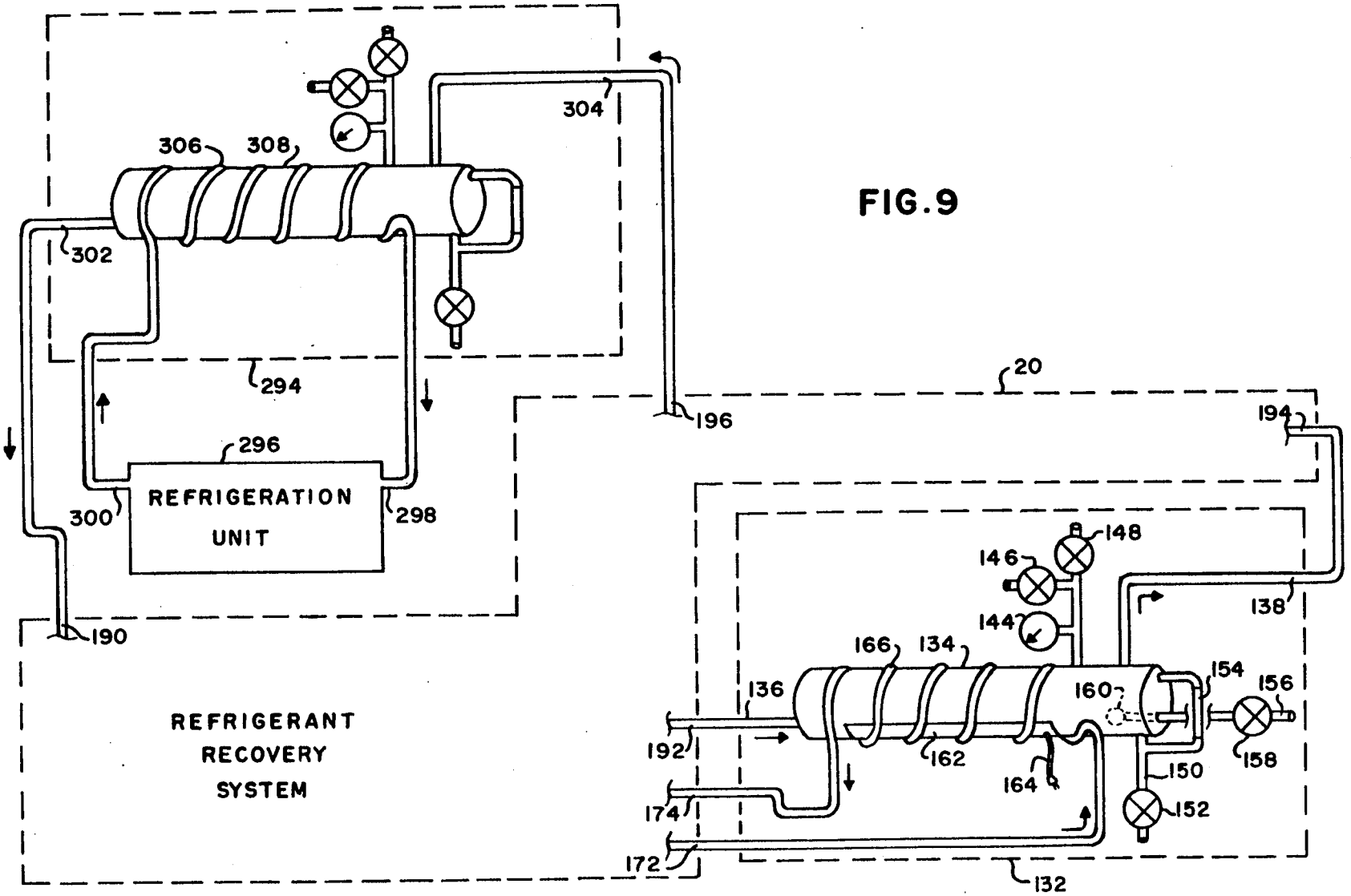
FIG. 9 is a diagram of the present invention configured to distill the refrigerant used in an air conditioning unit while the air conditioning unit is undergoing repair, with the air conditioning unit shown temporarily replaced by a storage tank and a refrigeration unit, and with valves and inactive elements omitted for clarity.

In most cases, large air conditioning units, such as those using R-11 refrigerant, may have their refrigerant distilled while they are in operation. However, if air conditioning unit 22 is not operational, as if, for instance, it is undergoing repair, distillation may proceed using a second storage tank 294 and second refrigeration unit 296 as shown in FIG. 9. In this configuration, it should be understood that refrigerant recovery system 20 in FIG. 9 is configured in the refrigerant distillation configuration, as, for example, in FIG. 8, while second storage tank 294 and second refrigeration unit 296 replace air conditioning unit 22. Refrigeration unit 296 is substantially the same as refrigeration unit 66, shown in FIG. 2, having an inlet 298 and an outlet 300 corresponding to inlet 80 and outlet 82, respectively, of refrigeration unit 66. Second storage tank 294 is similar to storage tank 132, having a first port 302 for removal of liquid refrigerant from the tank, and a second port 304 for replacement of refrigerant in vapor form into the tank, corresponding to ports 136 and 138, respectively, of tank 132. Second storage tank 294 may also have tank cooling means for cooling refrigerant within, similar to the tank cooling means for storage tank 132; the tank cooling means for storage tank 294, like that for tank 132, preferably comprises tubing, such as tubing 306, coiled around tank body 308 of second storage tank 294 and in close contact therewith, through which may flow a supply of coolant, preferably a CFC refrigerant, to and from refrigeration unit 296, in a manner similar to that used in cooling tank 132. Since second storage tank 294 will not be used for purging an air conditioning unit, it need not have a float valve similar to float valve 160 of storage tank 132 nor a structure corresponding to third port 156 or valve 158 of storage tank 132. Also, since second storage tank 294 will only be used to cool the refrigerant, it need not have a heater, such as heater 162 of storage tank 132. Distillation using a second storage tank and second refrigeration unit proceeds in a similar manner to that described above with air conditioning unit 22, with second refrigeration unit 296 cooling storage tank 294 while heater 162 heats storage tank 32 in a manner that will now be apparent. After distillation, second storage tank 294 may be emptied and evacuated using the refrigerant removal configuration and the evacuate/purge configuration, previously described.

Valve 130 may be closed when the removed refrigerant is within storage tank 132, allowing the temperature of tank 132 to be maintained by unit 66 until subsequent distilling to second storage tank 294 can commence. Alternatively, if cooled refrigerant is being stored in tank 132, closure of valve 130 allows unit 66 to hold tank 132 and the refrigerant therein at a cool temperature. For example, it might be necessary to interrupt the processing of refrigerant to allow repairs on portions of recovery system 20 such as pump 216; by maintaining the temperature of tank 132 and refrigerant therein, the processing of refrigerant can quickly be resumed without a delay, which otherwise would be necessary while tank 132 and the refrigerant therein recovered from any change in temperature during the interruption.

The refrigerant recovery system may also be used to pressurize an R-11 air conditioning unit so that the air conditioning unit may be checked for the presence of leaks. In this configuration, the air conditioning unit pressurization configuration, not separately shown, refrigerant recovery system is configured as in the refrigerant distillation configuration, above, and similarly attached to air conditioning unit 22 as described above, except that air conditioning unit 22 will not be running while being pressure tested. Additionally, to accelerate the process, the condenser coils 36 and evaporator coils 42 (see FIG. 3) of air conditioning unit 22 should be drained of water, and both the condenser and the chilled water pump of air conditioning unit 22 should be turned off. Hot coolant gas, passing through hot gas bypass valve 116, will cause refrigerant within evaporator 64 to boil as previously described, thereby raising the refrigerant vapor pressure within system 20 and thereby also raising the pressure within air conditioning unit 22, connected to system 20. Also, if desired, heater 162 on storage tank 132 may be used to additionally heat the refrigerant within tank 132, as may coiled tubing 166, with hot vaporized coolant gas flowing therethrough, with ends connected to auxiliary ports 172 and 174 (in a manner previously described), causing the pressure to rise more quickly. After leaks have been located in air conditioning unit 22, the refrigerant therein may be removed and the unit evacuated in a manner previously described, prior to detaching the air conditioning unit for maintenance.

If air conditioning unit 22 is in need of repair after substantially all the refrigerant therein has been removed, in a manner previously described, and placed into storage tank 132, the repairs may be performed while the refrigerant is simultaneously being decontaminated by configuring refrigerant recovery system 20 into the off-line refrigerant decontamination configuration. In this configuration, air conditioning unit 22 is replaced by a liquid pump 318 (see FIG. 1 and !0 , well known to those skilled in the art, having a suction inlet 320 and a discharge outlet 322. Pump 318 preferably is of the self-priming variety, and may have gauges 324 for monitoring the pressure at suction inlet 320 and discharge outlet 322. Couplings 190 and 196 of system 20 are connected to suction inlet 320 and discharge outlet 322, respectively, of liquid pump 318, while couplings 192 and 194 of system 20 are connected to first and second ports 136 and 138, respectively, of storage tank 132. Valves 256, 260, 268, 270, 272, 276, and 278 on system 20 are closed, while valves 254, 258, 262, 264, 266, 274, and 280 are open. Also, oil separator drain valve 214 is closed. On storage tank 132, valves 140 and 142 are open, while valves 152 and 158 are closed. Also, refrigeration unit 66 is turned off in the refrigerant replacement configuration since as previously explained, were it to cool evaporator 64 or storage tank 132, they would tend to hold refrigerant, which tends to flow to the coldest point of a refrigeration system. Since neither refrigeration unit 66 nor the tank cooling means for storage tank 132 are used in this configuration, the state of valves 130, 176, and 178 within cooling means 2, as well as that of valves 168 and 170 on storage tank 132, does not matter, as will now be apparent, but, for convenience, and to ensure that coolant does not escape into the atmosphere if storage tank 132 is disconnected from system 20, these valves will preferably be closed.

Figure 10:
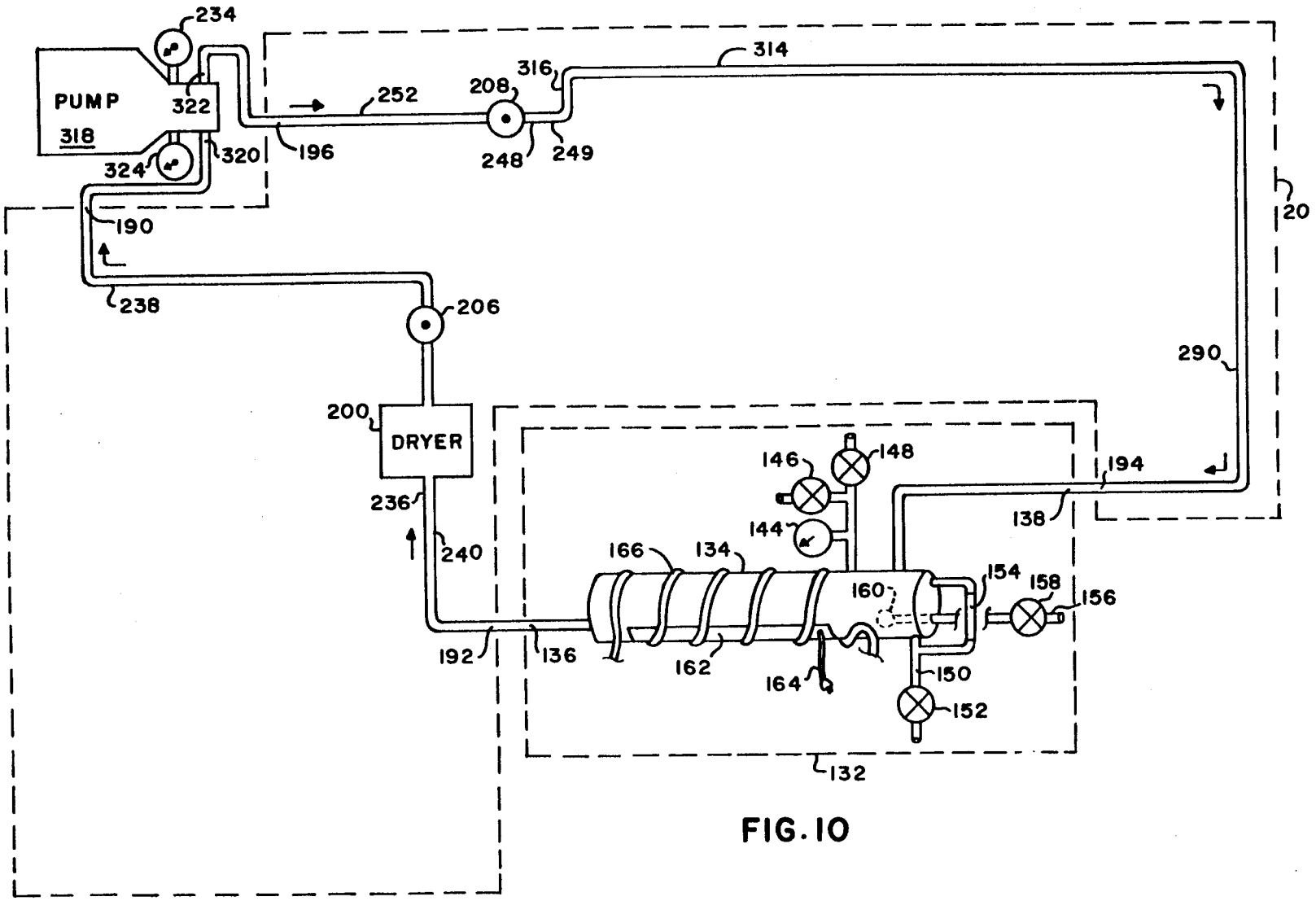
FIG. 10 is a diagram of the present invention configured to decontaminate the refrigerant used in an air conditioning unit while the air conditioning unit is undergoing repair, with the air conditioning unit shown temporarily replaced by a pump, and with valves and inactive elements omitted for clarity.

Thus configured in the off-line refrigerant decontamination configuration, system 20 is seen to have the topology shown in FIG. 10, where all valves and inactive elements have been removed for clarity. In this configuration, first end 238 of tubing 236 is connected to first coupling 190 of system 20 through valve 254; second end 240 of tubing 236 is connected to second coupling 192 through valves 258 and 262; second end 252 of tubing 248 is connected to coupling 196 through valve 274; tubing 314, connected at one end 316 to a portion 249 of tubing 248, preferably between dry eye sight glass 208 and dryer 202, is connected at the other end to coupling 194 through valves 280, 266, tubing 290, and valve 264, thereby connecting coupling 196 to coupling 194.

The refrigerant within tank 132 is decontaminated by being drawn in liquid form from port 136, through dryer 200, where moisture is removed, and through sight glass 206, to suction inlet 320 of pump 318. Pump 318 then forces the refrigerant out discharge outlet 322, through dry eye sight glass 208, and back into tank 132 through port 138. If desired, the refrigerant may be further decontaminated by next configuring system 20 into the refrigerant distillation configuration, previously described, and distilling the refrigerant back into air conditioning unit 22.

It should be understood that the present invention may be scaled up or down in size, with a small version being suited for portability, while a large version would be more suited for use in a fixed refrigerant recovery station for large scale processing of refrigerant. It also may be installed as a permanent part of an air conditioning unit, eliminating the need to transport the system to the site of the air conditioning unit each time maintenance is required, and may replace the purge pump often installed on an air conditioning unit at the time of manufacture by factory personnel since such a purge pump is unnecessary when the present invention is employed, as previously described.

The preferred embodiment of the refrigerant removal method of the present invention for removing liquid CFC refrigerant from an air conditioning unit into a storage tank includes the steps of creating a temperature gradient between the liquid refrigerant within the air conditioning unit and liquid refrigerant within the storage tank by cooling liquid refrigerant emerging from a liquid removal port on the air conditioning unit and then storing the refrigerant in the tank, while pumping refrigerant vapor within the tank out of the tank and back into the air conditioning unit. The temperature gradient between the air conditioning unit and the storage tank cause liquid refrigerant to flow from the air conditioning unit to the storage tank in accordance with the well known principle of thermodynamics that liquid CFC refrigerant will gravitate toward the coldest part of a refrigeration system. The pumping of the refrigerant vapor within the tank back into the air conditioning unit prevents pressure buildup within the tank, while also forcing liquid refrigerant within the air conditioning unit to be expelled from the air conditioning unit, as well as preventing the retention of liquid refrigerant by the air conditioning unit that otherwise might occur as liquid refrigerant removal lowers the pressure within the air conditioning unit. The cooling of the liquid refrigerant uses a liquid coolant other than water, preferably a CFC refrigerant, separate from the refrigerant being removed and which does not intermix with the refrigerant being removed, thereby allowing the method to be practiced at sites lacking a source of water, and also allowing the method to be used to remove refrigerant from an inoperative air conditioning unit, since the cooling does not rely on the air conditioning unit to cool the removed refrigerant. It should be understood that the step of creating a temperature gradient between the air conditioning unit and the storage tank may comprise the step of cooling the liquid refrigerant as it flows from the air conditioning unit, or the step of cooling the storage tank alone, or a combination of the two steps together, thereby increasing the temperature gradient between the air conditioning unit and the storage tank by increasing the amount of cooling of the liquid refrigerant. The liquid refrigerant preferably is cooled to a temperature below thirty degrees Fahrenheit, since increased cooling accelerates the removal process in a manner previously described. The removal method may additionally comprise the steps of drying the liquid refrigerant as it is being removed, drying the refrigerant vapor being pumped back into the air conditioning unit, and removing oil from the refrigerant vapor being pumped back into the air conditioning unit, thus decontaminating the refrigerant as it is removed.

After substantially all of the liquid refrigerant has been removed from the air conditioning unit, the air conditioning unit ma be substantially evacuated of air and remaining CFC refrigerant vapor by pumping the air and refrigerant vapor mixture from the air conditioning unit into the storage tank while cooling the mixture to a temperature sufficient to cause the refrigerant vapor to condense into liquid form, but not so cold as to condense the removed air, as CFC refrigerant has a higher boiling point than does air, and storing the condensed liquid refrigerant in the tank, while releasing excess air pressure buildup within the tank. The step of cooling the mixture uses a liquid coolant other than water, preferably a CFC refrigerant, separate from the refrigerant previously removed and which does not intermix with that refrigerant, thereby allowing the method to be practiced at sites lacking a source of water or at sites with an inoperative air conditioning unit, since the cooling does not rely on the air conditioning unit to cool the removed refrigerant. While evacuating the air conditioning unit, the refrigerant may be decontaminated by drying the refrigerant vapor to remove moisture, and by removing oil from the vapor.

When refrigerant replacement back into the air conditioning unit is desired, the replacement may be accomplished by the steps of pumping refrigerant vapor from the air conditioning unit into the tank, and allowing liquid refrigerant within the tank to be forced back into the air conditioning unit by the vapor pumped into the tank from the air conditioning unit. The method of subsequent refrigerant replacement ay additionally and preferably comprise the steps of drying the liquid refrigerant being forced from the tank back into the air conditioning unit, and separating oil from the refrigerant vapor being pumped from the air conditioning unit into the tank, thus further decontaminating the refrigerant as it is being replaced into the air conditioning unit.

The apparatus described herein can be seen to be but one of any mechanisms for implementing the above method of refrigerant removal, and possible subsequent refrigerant replacement.

Although the present invention has been described and illustrated with respect to preferred embodiments and a preferred use therefor, it is not to be so limited since modifications and changes can be made therein which are within the full intended scope of the invention.

I claim:

1. A refrigerant recovery system, adapted to be connected to an air conditioning unit which uses a CFC refrigerant, said refrigerant having a liquid form and a vapor form, said refrigerant recovery system being additionally adapted to be connected to a storage tank, said air conditioning unit having:

a. refrigerant reservoir means for holding said refrigerant in said liquid form;

b. first coupling means, in communication with the refrigerant reservoir means, for allowing removal from and return to said air conditioning unit of said refrigerant in said liquid form; and, c. second coupling means for allowing removal from and return to said air conditioning unit of said refrigerant in said vapor form;

said storage tank having:

a. first port means, in communication with the interior of the tank, for allowing said refrigerant in said liquid form to enter and exit said storage tank; and b. second port means, also in communication with the interior of the tank, for allowing said refrigerant in said vapor form to enter and exit said storage tank;

said refrigerant recovery system comprising:

a. cooling means, having an inlet and an outlet, for cooling said refrigerant as it passes through the cooling means from the inlet to the outlet by using a liquid coolant other than water to absorb heat from said refrigerant without commingling said coolant with said refrigerant, thereby cooling said refrigerant;

b. a first tubing, connected at one end to the inlet of the cooling means, and adapted to be connected at the other end to said first coupling means of said air conditioning unit, for removal from said air conditioning unit of said refrigerant in said liquid form;

c. a second tubing, connected at one end to the outlet of the cooling means, and adapted to be connected at the other end to said first port means of said storage tank;

d. pump means having a suction inlet and an exhaust outlet for pumping said refrigerant in said vapor form from said suction inlet to said exhaust outlet;

e. a third tubing, connected at one end to he suction inlet of the pump means, and adapted to be connected at the other end to said second port means of said storage tank; and, f. a fourth tubing, connected at one end to the exhaust outlet of the pump means, and adapted to be connected at the other end to said second coupling means of said air conditioning unit, for return to said air conditioning unit of said refrigerant in said vapor form.

2. The refrigerant recovery system as recited in claim 1, wherein the liquid coolant used within the cooling means is a CFC coolant, and wherein the cooling means comprises:

a. an evaporator having an evaporator inlet and an evaporator outlet, said evaporator inlet being connected to the inlet of the cooling means and said evaporator outlet being connected to the outlet of the cooling means;

b. refrigeration unit means for cooling said CFC coolant; and, c. conduit means for passing said cooled CFC coolant from the refrigeration unit means, through the evaporator for absorption of heat from the refrigerant in said liquid form, and back to the refrigeration unit means, thereby cooling said refrigerant within the evaporator.

3. The refrigerant recovery system as recited in claims 1 or 2, wherein the refrigerant recovery system additionally comprises:

a. first dryer means for removing moisture from said refrigerant, said first dryer means being inserted in a portion of said first tubing before the inlet of the cooling means;

b. second dryer means for removing moisture from said refrigerant, said second dryer means being inserted in a portion of said fourth tubing after the exhaust outlet of the pump means; and, c. oil separator means for removing oil from said refrigerant, said oil separator means being inserted in a portion of said fourth tubing between the second dryer means and the exhaust outlet of the pump means.

4. In combination, a refrigerant recovery system, for connection to an air conditioning unit which uses a CFC refrigerant, said refrigerant having a liquid form and a vapor form, and a storage tank, said air conditioning unit having:

a. refrigerant reservoir means for holding said refrigerant in said liquid form;

b. first coupling means, in communication with the refrigerant reservoir means, for allowing removal from the return to said air conditioning unit of said refrigerant in said liquid form; and, c. second coupling means for removal from and return to said air conditioning unit of said refrigerant in said vapor form;

said storage tank comprising:

a. first port means, in communication with the interior of the tank, for allowing said refrigerant in said liquid form to enter and exit the storage tank; and, b. second port means, also in communication with the interior of the tank, for allowing said refrigerant in said vapor form to enter and exit the storage tank;

said refrigerant recovery system comprising:

a. cooling means, having an inlet and an outlet, for cooling said refrigerant as it passes through the cooling means from the inlet to the outlet by using a liquid coolant other than water to absorb heat from said refrigerant without commingling said coolant with said refrigerant, thereby cooling said refrigerant;

b. a first tubing, connected at one end to the inlet of the cooling means, and for connection at the other end to said first coupling means of said air conditioning unit, for removal from said air conditioning unit of said refrigerant in said liquid form;

c. a second tubing connecting the outlet of the cooling means to the first port means of the storage tank;

d. pump means having a suction inlet and an exhaust outlet for pumping said refrigerant in said vapor form from said suction inlet to said exhaust outlet;

e. a third tubing connecting the suction inlet of the pump means to the second port means of he storage tank; and, f. a fourth tubing, connected at one end to the exhaust outlet of the pump means, and for connection at the other end to said second coupling means of said air conditioning unit, for return to said air conditioning unit of said refrigerant in said vapor form.

5. The refrigerant recovery system as recited in claim 4, wherein the liquid coolant used within the cooling means is a CFC coolant, and wherein the cooling means comprises:

a. an evaporator having an evaporator inlet and an evaporator outlet, said evaporator inlet being connected to the inlet of the cooling means and said evaporator outlet being connected to the outlet of the cooling means;

b. refrigeration unit means for cooling said CFC coolant; and, c. conduit means for passing said cooled CFC coolant from the refrigeration unit means, through the evaporator for absorption of heat from the refrigerant in said liquid form, and back to the refrigeration unit means, thereby cooling said refrigerant within the evaporator.

6. The refrigerant recovery system as recited in claims 4 or 5, wherein the storage tank additionally comprises means for cooling said refrigerant within the storage tank.

7. The refrigerant recovery system as recited in claims 4 or 5, wherein the refrigerant recovery system additionally comprises:

a. first dryer means for removing moisture from said refrigerant, said first dryer means being inserted in a portion of said first tubing before the inlet of the cooling means;

b. second dryer means for removing moisture from said refrigerant, said second dryer means being inserted in a portion of said fourth tubing after the exhaust outlet of the pump means; and, c. oil separator means for removing oil from said refrigerant, said oil separator means being inserted in a portion of said fourth tubing between the second dryer means and the exhaust outlet of the pump means.

8. A refrigerant recovery system, adapted to be connected to an air conditioning unit which uses a CFC refrigerant, said refrigerant having a liquid form and a vapor form, said refrigerant recovery system being additionally adapted to the connected to a storage tank, said air conditioning unit having:

a. refrigerant reservoir means for holding said refrigerant in said liquid form;

b. first coupling means, in communication with the refrigerant reservoir means, for allowing removal from and return to said air conditioning unit of said refrigerant in said liquid form; and, c. second coupling means for removal from and return to said air conditioning unit of said refrigerant in said vapor form;

said storage tank having:

a. first port means, in communication with the interior of the tank, for allowing said refrigerant in said liquid form to enter and exit said storage tank; and, b. second port means, also in communication with the interior of the tank, for allowing said refrigerant in said vapor form to enter and exit said storage tank;

said refrigerant recovery system comprising:

a. cooling means, having an inlet and an outlet, for cooling said refrigerant as it passes through the cooling mean from the inlet to the outlet by using a liquid coolant other than water to absorb heat from said refrigerant without commingling said coolant with said refrigerant, thereby cooling said refrigerant;

b. a first coupling adapted to be connected to said first coupling means of said air conditioning unit, for removal from and return to said air conditioning unit of said refrigerant in said liquid form;

c. a first tubing, having a first end and a second end, said first end being connected to the inlet of the cooling means;

d. a second coupling adapted to be connected to said first port mean of said storage tank;

e. a second tubing connected at a first end to the outlet of the cooling means, and for connection at a second end to the second coupling of the refrigerant recovery system, for emptying said refrigerant into said storage tank;

f. a third tubing, for connection at a first end to the first coupling of the refrigerant recovery system, and for connection at a second end to the second coupling of the refrigerant recovery system, for return to said air conditioning unit of said refrigerant in said liquid form;

g. pump means having a suction inlet and an exhaust outlet for pumping said refrigerant in said vapor form from said suction inlet to said exhaust outlet;

h. a third coupling adapted to be connected to said second port means of said storage tank;

i. a fourth coupling adapted to be connected to said second coupling means of said air conditioning unit, for removal from and return to said air conditioning unit of said refrigerant in said vapor form;

j. a fourth tubing, having a first end and a second end, said first end being connected to the exhaust inlet of the pump means;

k. a fifth tubing, for connection at a first end to the second end of the fourth tubing, and for connection at a second end to the fourth coupling of the refrigerant recovery system;

l. means for selectively configuring the refrigerant recovery system into a set of configurations, said set of configurations comprising:

i. a refrigerant removal configuration, said refrigerant removal configuration being the condition where:

(a) the second end of the first tubing is connected to the first coupling of the refrigerant recovery system;

(b) the second end of the second tubing is connected to the second coupling of the refrigerant recovery system;

(c) the suction inlet of the pump means is connected to the third coupling of the refrigerant recovery system;

(d) the second end of the fourth tubing is connected to the first end of the fifth tubing; and, (e) the second end of the fifth tubing is connected to the fourth coupling of the refrigerant recovery system; and, ii. a refrigerant replacement configuration, said refrigerant replacement configuration being the condition where:

(a) the first end of the third tubing is connected to the first coupling of the refrigerant recovery system;

(b) the second end of the third tubing is connected to the second coupling of the refrigerant recovery system;

(c) the second end of the fourth tubing is connected to the third coupling of the refrigerant recovery system; and, (d) the suction inlet of the pump means is connected to the fourth coupling of the refrigerant recovery system.

9. The refrigerant recovery system as recited in claim 8, wherein the liquid coolant used within the cooling means is a CFC coolant, and wherein the cooling means comprises:

a. an evaporator having an evaporator inlet and an evaporator outlet, said evaporator inlet being connected to the inlet of the cooling means and said evaporator outlet being connected to the outlet of the cooling means;

b. refrigeration unit means for cooling said CFC coolant; and, c. conduit means for passing said cooled CFC coolant from the refrigeration unit means, through the evaporator for absorption of heat from the refrigerant in said liquid form, and back to the refrigeration unit means, thereby cooling said refrigerant within the evaporator.

10. The refrigerant recovery system as recited in claims 8 or 9, wherein the refrigerant recovery system additionally comprises:

a. first dryer means for removing moisture form said refrigerant, said first dryer means being inserted in a portion of said first tubing before the inlet of the cooling means;

b. second dryer means for removing moisture from said refrigerant, said second dryer means being inserted in a portion of said third tubing;

c. third dryer means for removing moisture from said refrigerant, said third dryer means being inserted in a portion of said fifth tubing; and, d. oil separator means for removing oil from said refrigerant, said oil separator means being inserted in a portion of said fourth tubing after the exhaust outlet of the pump means.

11. The refrigerant recovery system as recited in claims 8 or 9, wherein the set of configurations additionally comprises an evacuate/purge configuration, said evacuate/purge configuration being the condition where:

a. the suction inlet of the pump means is connected to the fourth coupling of the refrigerant recovery system;
b. the second end of the fourth tubing is connected to the second end of the first tubing; and,
c. the second end of the second tubing is connected to the second coupling of the refrigerant recovery system.

12. The refrigerant recovery system as recited in claim 11, wherein the refrigerant recovery system additionally comprises:
a. first dryer means for removing moisture from said refrigerant, said first dryer means being inserted in a portion of said first tubing before the inlet of the cooling means;
b. second dryer means for removing moisture from said refrigerant, said second dryer means being inserted in a portion of said third tubing;
c. third dryer means for removing moisture from said refrigerant, said third dryer means being inserted in a portion of said fifth tubing; and,
d. oil separator means for removing oil from said refrigerant, said oil separator means being inserted in a portion of said fourth tubing after the exhaust outlet of the pump means.

13. In combination, a refrigerant recovery system, for connection to an air conditioning unit which uses a CFC refrigerant, said refrigerant having a liquid form and a vapor form, and a storage tank,
said air conditioning unit having:
a. refrigerant reservoir means for holding said refrigerant in said liquid form;
b. first coupling means, in communication with the refrigerant reservoir means, for allowing removal from and return to said air conditioning unit of said refrigerant in said liquid form; and,
c. second coupling means for allowing removal from and return to said air conditioning unit of said refrigerant in said vapor form;
said storage tank comprising:
a. first port means, in communication with the interior of the tank, for allowing said refrigerant in said liquid form to enter and exit the storage tank; and,
b. second part means, also in communication with the interior of the tank, for allowing said refrigerant in said vapor form to enter and exit the storage tank;
said refrigerant recovery system comprising:
a. cooling means, having an inlet and an outlet, for cooling said refrigerant as it passes through the cooling means from the inlet to the outlet by using a liquid coolant other than water to absorb heat from said refrigerant without commingling said coolant with said refrigerant, thereby cooling said refrigerant;
b. a first coupling for connection to said first coupling means of said air conditioning unit, for removal form and return to said air conditioning unit of said refrigerant in said liquid form;
c. a first tubing, having a first end and a second end, said first end being connected to the inlet of the cooling means;
d. a second coupling connected to the first port means of the storage tank;
e. a second tubing connected at a first end to the outlet of the cooling means, and for connection at a second end to the second coupling of the refrigerant recovery system, for emptying said refrigerant into the storage tank;
f. a third tubing, for connection at a first end to the first coupling of the refrigerant recovery system, and for connection at a second end to the second coupling of the refrigerant recovery system, for return to said air conditioning unit of said refrigerant in said liquid form;
g. pump means having a suction inlet and an exhaust outlet for pumping said refrigerant in said vapor form from said suction inlet to said exhaust outlet;
h. a third coupling connected to the second port means of the storage tank;
i. a fourth coupling for connection to said second coupling means of said air conditioning unit, for removal from and return to said air conditioning unit of said refrigerant in said vapor form;
j. a fourth tubing, having a first end and a second end, said first end being connected to the exhaust inlet of the pump means;
k. a fifth tubing, for connection at a first end to the second end of the fourth tubing, and for connection at a second end to the fourth coupling of the refrigerant recovery system;
l. means for selectively configurating the refrigerant recovery system into a set of configurations, said set of configurations comprising:
i. a refrigerant removal configuration, said refrigerant removal configuration being the condition where:
(a) the second end of the first tubing is connected to the first coupling of the refrigerant recovery system;
(b) the second end of the second tubing is connected to the second coupling of the refrigerant recovery system;
(c) the suction inlet of the pump mean is connected to the third coupling of the refrigerant recovery system;
(d) the second end of the fourth tubing is connected to the first end of the fifth tubing; and,
(e) the second end of the fifth tubing is connected to the fourth coupling of the refrigerant recovery system; and,
ii. a refrigerant replacement configuration, said refrigerant replacement configuration being the condition where:
(a) the first end of the third tubing is connected to the first coupling of the refrigerant recovery system;
(b) the second end of the third tubing is connected to the second coupling of the refrigerant recovery system;
(c) the second end of the fourth tubing is connected to the third coupling of the refrigerant recovery system; and,
(d) the suction inlet of the pump means is connected to the fourth coupling of the refrigerant recovery system.

14. The refrigerant recovery system as recited in claim 13, wherein the liquid coolant used within the cooling means is a CFC coolant, and wherein the cooling means comprises:
a. an evaporator having an evaporator inlet and an evaporator outlet, said evaporator inlet being connected to the inlet of the cooling means and said evaporator outlet being connected to the outlet of the cooling means;
b. refrigeration unit means for cooling said CFC coolant; and, c. conduit means for passing said cooled CFC coolant from the refrigeration unit means, through the evaporator for absorption of heat from the refrigerant in said liquid form, and back to the refrigeration unit means, thereby cooling said refrigerant within the evaporator.

15. The refrigerant recovery system as recited in claims 13 or 14, wherein the storage tank additionally comprises means for cooling said refrigerant within the storage tank.

16. The refrigerant recovery system as recited in claims 13 or 14, wherein the refrigerant recovery system additionally comprises:

a. first dryer means for removing moisture from said refrigerant, said first dryer means being inserted in a portion of said first tubing before the inlet of the cooling means;

b. second dryer means for removing moisture from said refrigerant, said second dryer means being inserted in a portion of said third tubing;

c. third dryer means for removing moisture from said refrigerant, said third dryer means being inserted in a portion of said fifth tubing; and, d. oil separator means for removing oil from said refrigerant, said oil separator means being inserted in a portion of said fourth tubing after the exhaust outlet of the pump means.

17. The refrigerant recovery system as recited in claims 13 or 14, wherein the set of configurations additionally comprises an evacuate/purge configuration, said evacuate/purge configuration being the condition where:

a. the suction inlet of the pump means is connected to the fourth coupling of the refrigerant recovery system;

b. the second end of the fourth tubing is connected to the second end of the first tubing; and, c. the second end of the second tubing is connected to the second coupling of the refrigerant recovery system.

18. The refrigerant recovery system as recited in claim 17, wherein the refrigerant recovery system additionally comprises:

a. first dryer means for removing moisture from said refrigerant, said first dryer means being inserted in a portion of said first tubing before the inlet of the cooling means;

b. second dryer means for removing moisture from said refrigerant, said second dryer means being inserted in a portion of said third tubing;

c. third dryer means for removing moisture from said refrigerant, said third dryer means being inserted in a portion of said fifth tubing; and, d. oil separator means for removing oil from said refrigerant, said oil separator means being inserted in a portion of said fourth tubing after the exhaust outlet of the pump means.

19. The refrigerant recovery system as recited in claim 18, wherein the storage tank additionally comprises means for cooling said refrigerant within the storage tank.

20. The refrigerant recovery system as recited in claims 1 or 8, in which the cooling means is for cooling the refrigerant to a temperature below thirty degrees Fahrenheit.

* * * * *